US010874162B2

(12) United States Patent
Bologna et al.

(10) Patent No.: US 10,874,162 B2
(45) **Date of Patent: *Dec. 29, 2020**

(54) PROTECTIVE SPORTS HELMET

(71) Applicant: Riddell, Inc., Des Plaines, IL (US)

(72) Inventors: Vitorrio Bologna, Elk Grove, IL (US); Nelson Kraemer, Mount Prospect, IL (US); Ralph Infusino, Bloomingdale, IL (US); Thad M. Ide, Chicago, IL (US)

(73) Assignee: Riddell, Inc., Des Plaines, IL (US)

( * ) Notice: Subject to any disclaimer, the term of this patent is extended or adjusted under 35 U.S.C. 154(b) by 245 days.

This patent is subject to a terminal disclaimer.

(21) Appl. No.: 15/705,984

(22) Filed: Sep. 15, 2017

(65) Prior Publication Data

US 2018/0042331 A1 Feb. 15, 2018

Related U.S. Application Data

(63) Continuation of application No. 13/229,165, filed on Sep. 9, 2011, now Pat. No. 9,763,488.

(51) Int. Cl.
*A42B 3/12* (2006.01)

(52) U.S. Cl.
CPC ..... *A42B 3/127* (2013.01); *A42B 3/122* (2013.01); *A42B 3/128* (2013.01)

(58) Field of Classification Search
CPC .. A42B 3/10; A42B 3/12; A42B 3/121; A42B 3/122; A42B 3/125; A42B 3/127; A42B 3/128

(Continued)

(56) References Cited

U.S. PATENT DOCUMENTS 1,060,220 A 4/1913 White
1,203,564 A 11/1916 April
(Continued)

FOREIGN PATENT DOCUMENTS

CA 2778050 A1 4/2011
CH 692011 1/2002
(Continued)

OTHER PUBLICATIONS

Claim Construction Opinion and Order; *Riddell, Inc.* v. *Schutt Sports, Inc.*; U.S. District Court for the W.D. of Wisconsin; 08-cv-711; dated Jul. 10, 2009.

(Continued)

*Primary Examiner* — Jameson D Collier
(74) *Attorney, Agent, or Firm* — Barnes & Thornburg LLP

(57) ABSTRACT

The present invention is directed to a protective sports helmet including a helmet shell, a face guard and an internal padding assembly positioned within the helmet shell. The internal padding assembly includes a brow pad having a first peripheral connection portion and a second peripheral connection portion. The internal padding assembly also includes a first jaw pad having an upper connection portion that mates with the first connection portion of the brow pad, and a second jaw pad having an upper connection portion that mates with the second connection portion of the brow pad. The internal padding assembly also includes a crown assembly with pad elements that include an internal separation layer that partitions the element into a first inflatable section and a second un-inflatable section. The connection portion of the jaw pads also mates with frontal pad elements of the crown assembly. The internal padding assembly further includes an occipital pad assembly that engages the helmet wearer's head below the occipital bone.

20 Claims, 14 Drawing Sheets

(58) Field of Classification Search
USPC ..... 2/410–415, 425
See application file for complete search history.

(56) References Cited

U.S. PATENT DOCUMENTS

| | | | |
|---|---|---|---|
| 1,262,818 | A | 4/1918 | McGill |
| 1,449,183 | A | 3/1923 | Jonhstone |
| 1,522,952 | A | 1/1925 | Goldsmith |
| 1,655,007 | A | 1/1928 | Boettge |
| 1,691,202 | A | 11/1928 | Van |
| 1,705,879 | A | 3/1929 | Rodgers |
| 1,833,708 | A | 11/1931 | Ford |
| 1,868,926 | A | 7/1932 | Tatore |
| 1,892,943 | A | 1/1933 | Geyer |
| 2,140,716 | A | 12/1938 | Pryale |
| 2,150,290 | A | 3/1939 | Mulvey |
| 2,194,903 | A | 3/1940 | Holstein |
| 2,250,275 | A | 7/1941 | Riddell |
| 2,296,335 | A | 9/1942 | Brady |
| 2,354,840 | A | 8/1944 | Seletz |
| 2,359,387 | A | 10/1944 | Riddell |
| 2,451,483 | A | 10/1948 | Goldsmith |
| 2,525,389 | A | 10/1950 | Zeller |
| 2,570,182 | A | 10/1951 | Daly et al. |
| 2,634,415 | A | 4/1953 | Turner |
| 2,679,046 | A | 5/1954 | Dye |
| 2,688,747 | A | 9/1954 | Marx |
| 2,758,304 | A | 8/1956 | McGowan |
| 2,768,380 | A | 10/1956 | Golomb |
| 2,777,127 | A | 1/1957 | Marietta |
| 2,785,405 | A | 3/1957 | Snyder |
| D180,239 | S | 5/1957 | McMurry |
| 2,850,740 | A | 9/1958 | Adams |
| 2,861,272 | A | 11/1958 | Stuart et al. |
| 2,867,811 | A | 1/1959 | Jones |
| 2,890,457 | A | 6/1959 | Marietta |
| 2,904,645 | A | 9/1959 | Sarles |
| 2,944,263 | A | 7/1960 | Rayburn |
| 2,969,546 | A | 1/1961 | Morgan, Jr. |
| 2,985,883 | A | 5/1961 | Marietta |
| 2,986,739 | A | 6/1961 | Rozzi |
| 3,039,108 | A | 6/1962 | Lohrenz |
| 3,082,427 | A | 3/1963 | Zbikowski |
| 3,106,716 | A | 10/1963 | Beebe |
| 3,113,318 | A | 12/1963 | Marietta |
| 3,153,973 | A | 10/1964 | Marietta |
| 3,155,981 | A | 11/1964 | Mckissick |
| 3,166,761 | A | 1/1965 | Strohm |
| 3,167,783 | A | 2/1965 | Wolfe |
| 3,174,155 | A | 3/1965 | Pitman |
| 3,186,004 | A | 6/1965 | Carlini |
| 3,187,342 | A | 6/1965 | Aileo |
| 3,189,917 | A | 6/1965 | Sims |
| 3,208,080 | A | 9/1965 | Hirsch |
| 3,216,023 | A | 11/1965 | Morgan |
| 3,223,086 | A | 12/1965 | Denton |
| 3,263,236 | A | 8/1966 | Humphrey |
| 3,274,612 | A | 9/1966 | Merriam |
| 3,274,613 | A | 9/1966 | Sowle |
| 3,283,336 | A | 11/1966 | Critser |
| 3,292,180 | A | 12/1966 | Marietta |
| 3,296,582 | A | 1/1967 | Ide |
| 3,315,272 | A | 4/1967 | Olt |
| 3,323,134 | A | 6/1967 | Swyers |
| 3,327,313 | A | 6/1967 | Pukish |
| 3,344,433 | A | 10/1967 | Stapenhill |
| 3,364,499 | A | 1/1968 | Kwoka |
| 3,447,162 | A | 6/1969 | Aileo |
| 3,447,163 | A | 6/1969 | Bothwell |
| 3,462,763 | A | 8/1969 | Schneider |
| 3,478,365 | A | 11/1969 | Tibor |
| 3,500,472 | A | 3/1970 | Castellani |
| 3,548,409 | A | 12/1970 | Aileo |
| 3,548,410 | A | 12/1970 | Parker |
| 3,566,409 | A | 3/1971 | Hopper |
| 3,568,210 | A | 3/1971 | Marietta |
| 3,577,562 | A | 5/1971 | Holt |
| 3,590,388 | A | 7/1971 | Holt |
| 3,600,714 | A | 8/1971 | Greathouse |
| 3,605,113 | A | 9/1971 | Charles |
| 3,609,764 | A | 10/1971 | Morgan |
| 3,616,463 | A | 11/1971 | Theodore |
| 3,619,813 | A | 11/1971 | Marchello |
| 3,629,864 | A | 12/1971 | Latina |
| 3,713,640 | A | 1/1973 | Margan |
| 3,720,955 | A | 3/1973 | Rawlings |
| 3,729,744 | A | 5/1973 | Rappleyea |
| 3,761,959 | A | 10/1973 | Dunning |
| 3,783,450 | A | 1/1974 | O'Connor |
| 3,785,395 | A | 1/1974 | Andreasson |
| 3,787,895 | A | 1/1974 | Belvedere |
| 3,793,241 | A | 2/1974 | Kyle et al. |
| D230,911 | S | 3/1974 | Ispas, Jr. |
| 3,815,152 | A | 6/1974 | Bednarczuk |
| 3,818,508 | A | 6/1974 | Lammers et al. |
| 3,820,163 | A | 6/1974 | Rappleyea |
| 3,843,970 | A | 10/1974 | Marietta et al. |
| 3,849,801 | A | 11/1974 | Holt |
| 3,854,146 | A | 12/1974 | Dunning |
| 3,872,511 | A | 3/1975 | Nichols |
| 3,882,547 | A | 5/1975 | Morgan |
| 3,916,446 | A | 11/1975 | Gooding |
| 3,934,271 | A | 1/1976 | Rhee |
| 3,946,441 | A | 3/1976 | Johnson |
| 3,992,721 | A | 11/1976 | Morton |
| 3,994,020 | A | 11/1976 | Villari |
| 3,994,021 | A | 11/1976 | Villari et al. |
| 3,994,022 | A | 11/1976 | Villari et al. |
| 3,999,220 | A | 12/1976 | Keltner |
| 4,006,496 | A | 2/1977 | Marker |
| 4,023,209 | A | 5/1977 | Frieder |
| 4,023,213 | A | 5/1977 | Rovani |
| 4,028,743 | A | 6/1977 | Christensen |
| 4,035,847 | A | 7/1977 | Prince |
| 4,038,700 | A | 8/1977 | Gyory |
| 4,044,400 | A | 8/1977 | Lewicki et al. |
| 4,054,953 | A | 10/1977 | De Barsy |
| 4,060,855 | A | 12/1977 | Rappleyea |
| 4,064,565 | A | 12/1977 | Griffiths |
| 4,075,714 | A | 2/1978 | Ryder et al. |
| 4,086,664 | A | 5/1978 | Humphrey et al. |
| 4,101,983 | A | 7/1978 | Dera et al. |
| 4,233,687 | A | 11/1980 | Lancelloti |
| 4,272,853 | A | 6/1981 | Schuessler |
| 4,279,038 | A | 7/1981 | Bruckner et al. |
| 4,282,610 | A | 8/1981 | Steigerwald |
| 4,287,613 | A | 9/1981 | Schulz |
| 4,307,471 | A | 12/1981 | Lovell |
| 4,345,338 | A | 8/1982 | Frieder, Jr. |
| 4,354,284 | A | 10/1982 | Gooding |
| D267,287 | S | 12/1982 | Gooding |
| 4,363,140 | A | 12/1982 | Correale |
| 4,370,759 | A | 2/1983 | Zide |
| 4,375,108 | A | 3/1983 | Gooding |
| 4,390,995 | A | 7/1983 | Walck |
| 4,398,306 | A | 8/1983 | Gooding |
| 4,404,690 | A | 9/1983 | Farquharson |
| D271,249 | S | 11/1983 | Farquharson |
| 4,432,099 | A | 2/1984 | Grick |
| 4,434,514 | A | 3/1984 | Sundahl |
| 4,461,044 | A | 7/1984 | Reiterman |
| 4,463,456 | A | 8/1984 | Hanson |
| 4,475,248 | A | 10/1984 | L'Abbe et al. |
| 4,477,929 | A | 10/1984 | Mattsson |
| 4,478,587 | A | 10/1984 | Mackal |
| 4,534,068 | A | 8/1985 | Mitchell |
| 4,555,816 | A | 12/1985 | Broersma |
| 4,566,137 | A | 1/1986 | Gooding |
| 4,627,115 | A | 12/1986 | Broersma |
| 4,633,531 | A | 1/1987 | Nimmons |
| 4,646,368 | A | 3/1987 | Infusino et al. |
| 4,651,356 | A | 3/1987 | Zide |
| 4,665,569 | A | 5/1987 | Santini |
| 4,677,694 | A | 7/1987 | Crow |

(56) References Cited

U.S. PATENT DOCUMENTS

| | | | |
|---|---|---|---|
| 4,692,947 | A | 9/1987 | Black et al. |
| 4,706,305 | A | 11/1987 | Cho |
| 4,724,549 | A | 2/1988 | Herder |
| 4,741,054 | A | 5/1988 | Mattes |
| 4,744,107 | A | 5/1988 | Fohl |
| 4,766,614 | A | 8/1988 | Cantwell |
| 4,774,729 | A | 10/1988 | Coates et al. |
| 4,794,652 | A | 1/1989 | Piech von Planta et al. |
| 4,808,469 | A | 2/1989 | Hiles |
| 4,821,344 | A | 4/1989 | Kamata |
| 4,831,668 | A | 5/1989 | Schulz |
| 4,837,866 | A | 6/1989 | Rector et al. |
| 4,853,980 | A | 8/1989 | Zarotti |
| 4,866,792 | A | 9/1989 | Arai |
| 4,885,806 | A | 12/1989 | Heller |
| 4,885,807 | A | 12/1989 | Snow, Jr. |
| 4,903,346 | A | 2/1990 | Reddermann et al. |
| 4,916,759 | A | 4/1990 | Arai |
| D309,512 | S | 7/1990 | Crow |
| 4,937,888 | A | 7/1990 | Straus |
| 4,947,490 | A | 8/1990 | Hayden |
| 4,982,452 | A | 1/1991 | Chaise |
| 4,996,724 | A | 3/1991 | Dextrase |
| 5,012,533 | A | 5/1991 | Raffler |
| 5,014,365 | A | 5/1991 | Schulz |
| 5,035,009 | A | 7/1991 | Wingo, Jr. et al. |
| 5,044,016 | A | 9/1991 | Coombs |
| 5,056,162 | A | 10/1991 | Tirums |
| 5,083,321 | A | 1/1992 | Davidsson |
| 5,093,936 | A | 3/1992 | Copeland et al. |
| 5,093,937 | A | 3/1992 | Kamata |
| 5,093,939 | A | 3/1992 | Noyerie et al. |
| 5,101,517 | A | 4/1992 | Douglas |
| 5,129,108 | A | 7/1992 | Copeland et al. |
| 5,136,728 | A | 8/1992 | Kamata |
| 5,142,700 | A | 8/1992 | Reed |
| 5,150,479 | A | 9/1992 | Oleson |
| 5,165,116 | A | 11/1992 | Simpson |
| D332,507 | S | 1/1993 | Anderson et al. |
| 5,175,889 | A | 1/1993 | Infusino |
| 5,177,815 | A | 1/1993 | Andujar |
| 5,177,816 | A | 1/1993 | Schmidt et al. |
| 5,204,998 | A | 4/1993 | Liu |
| 5,231,703 | A | 8/1993 | Garneau |
| 5,263,203 | A | 11/1993 | Kraemer et al. |
| 5,263,204 | A | 11/1993 | Butsch |
| 5,267,353 | A | 12/1993 | Milligan |
| 5,271,103 | A | 12/1993 | Darnell |
| 5,272,773 | A | 12/1993 | Kamata |
| 5,293,649 | A | 3/1994 | Corpus |
| 5,298,208 | A | 3/1994 | Sibley |
| 5,309,576 | A | 5/1994 | Broersma |
| 5,315,718 | A | 5/1994 | Barson |
| RE34,699 | E | 8/1994 | Copeland et al. |
| D350,710 | S | 9/1994 | Keiffer |
| 5,345,614 | A | 9/1994 | Tanaka |
| 5,347,660 | A | 9/1994 | Zide et al. |
| D355,394 | S | 2/1995 | Bezener |
| D357,555 | S | 4/1995 | Brueckner et al. |
| 5,418,257 | A | 5/1995 | Weisman |
| 5,448,780 | A | 9/1995 | Gath |
| 5,461,730 | A | 10/1995 | Carrington |
| D364,487 | S | 11/1995 | Tutton et al. |
| 5,493,736 | A | 2/1996 | Allison |
| 5,502,843 | A | 4/1996 | Strickland |
| 5,517,691 | A | 5/1996 | Blake |
| 5,522,091 | A | 6/1996 | Rudolf |
| 5,539,936 | A | 7/1996 | Thomas |
| 5,544,367 | A | 8/1996 | March, II |
| 5,553,330 | A | 9/1996 | Carveth |
| D378,236 | S | 2/1997 | Zanotto et al. |
| D378,624 | S | 3/1997 | Chartrand |
| 5,621,922 | A | 4/1997 | Rush, III |
| D382,671 | S | 8/1997 | Shewchenko |
| 5,655,227 | A | 8/1997 | Sundberg |
| D383,953 | S | 9/1997 | DeFilippo |
| 5,661,854 | A | 9/1997 | March, II |
| 5,713,082 | A | 2/1998 | Bassette et al. |
| 5,724,681 | A | 3/1998 | Sykes |
| 5,732,414 | A | 3/1998 | Monica |
| 5,734,994 | A | 4/1998 | Rogers |
| 5,737,770 | A | 4/1998 | Chen |
| 5,774,901 | A | 7/1998 | Minami |
| 5,790,988 | A | 8/1998 | Guadagnino, Jr. et al. |
| 5,794,270 | A | 8/1998 | Howat |
| 5,794,271 | A | 8/1998 | Hastings |
| 5,794,274 | A | 8/1998 | Kraemer |
| 5,799,337 | A | 9/1998 | Brown |
| 5,833,796 | A | 11/1998 | Matich |
| 5,867,840 | A | 2/1999 | Hirosawa |
| D406,399 | S | 3/1999 | Hohdorf |
| 5,883,145 | A | 3/1999 | Hurley et al. |
| D408,236 | S | 4/1999 | Rennick |
| 5,913,412 | A | 6/1999 | Huber et al. |
| 5,915,537 | A | 6/1999 | Dallas et al. |
| 5,930,840 | A | 8/1999 | Arai |
| 5,938,878 | A | 8/1999 | Hurley et al. |
| 5,941,272 | A | 8/1999 | Feldman |
| 5,943,706 | A | 8/1999 | Miyajima |
| 5,946,735 | A | 9/1999 | Bayes |
| 5,950,244 | A | 9/1999 | Fournier |
| 5,953,761 | A | 9/1999 | Jurga et al. |
| 5,956,777 | A | 9/1999 | Popovich |
| 5,963,990 | A | 10/1999 | White |
| 5,966,744 | A | 10/1999 | Smith |
| 6,032,297 | A | 3/2000 | Barthold |
| 6,047,400 | A | 4/2000 | Spencer |
| 6,054,005 | A | 4/2000 | Hurley et al. |
| 6,070,271 | A | 6/2000 | Williams |
| 6,073,271 | A | 6/2000 | Alexander et al. |
| 6,079,053 | A | 6/2000 | Clover, Jr. et al. |
| 6,081,932 | A | 7/2000 | Kraemer |
| 6,089,251 | A | 7/2000 | Pestel |
| 6,128,786 | A | 10/2000 | Maddux et al. |
| 6,138,284 | A | 10/2000 | Arai |
| 6,154,889 | A | 12/2000 | Moore, III |
| 6,159,324 | A | 12/2000 | Watters |
| 6,178,560 | B1 | 1/2001 | Halstead |
| 6,189,156 | B1 | 2/2001 | Loiars |
| 6,199,219 | B1 | 3/2001 | Silken et al. |
| 6,219,850 | B1 | 4/2001 | Halstead et al. |
| 6,226,801 | B1 | 5/2001 | Alexander et al. |
| 6,240,571 | B1 | 6/2001 | Infusino |
| D445,962 | S | 7/2001 | Brignone et al. |
| 6,256,798 | B1 | 7/2001 | Egolf |
| 6,261,042 | B1 | 7/2001 | Pratt |
| 6,272,692 | B1 | 8/2001 | Abraham |
| D448,526 | S | 9/2001 | Brignone et al. |
| 6,282,724 | B1 | 9/2001 | Abraham |
| 6,282,726 | B1 | 9/2001 | Noyerie et al. |
| D448,890 | S | 10/2001 | Brignone et al. |
| 6,298,483 | B1 | 10/2001 | Schiebl et al. |
| 6,298,497 | B1 | 10/2001 | Chartrand |
| 6,314,586 | B1 | 11/2001 | Duguid |
| 6,324,701 | B1 | 12/2001 | Alexander |
| 6,332,228 | B1 | 12/2001 | Takahara |
| 6,339,849 | B1 | 1/2002 | Nelson |
| D453,399 | S | 2/2002 | Racine |
| 6,351,853 | B1 | 3/2002 | Halstead |
| 6,360,376 | B1 | 3/2002 | Carrington |
| 6,370,699 | B1 | 4/2002 | Halstead et al. |
| 6,385,780 | B1 | 5/2002 | Racine |
| 6,389,607 | B1 | 5/2002 | Wood |
| D459,032 | S | 6/2002 | Gatellet |
| D459,554 | S | 6/2002 | Gatellet |
| D459,555 | S | 6/2002 | Gatellet |
| 6,421,841 | B2 | 7/2002 | Ikeda |
| 6,434,755 | B1 | 8/2002 | Halstead |
| 6,438,762 | B1 | 8/2002 | Jenkins |
| 6,438,763 | B2 | 8/2002 | Guay et al. |
| 6,446,270 | B1 | 9/2002 | Durr |
| D465,067 | S | 10/2002 | Ide et al. |
| 6,467,099 | B2 | 10/2002 | Dennis |
| 6,481,024 | B1 | 11/2002 | Grant |

(56) References Cited

U.S. PATENT DOCUMENTS

D466,651 S 12/2002 Halstead et al.
6,499,139 B1 12/2002 Brown et al.
6,499,147 B2 12/2002 Schiebl et al.
D475,486 S 6/2003 Ide et al.
6,604,246 B1 8/2003 Obreja
6,658,671 B1 12/2003 Von Holst
6,701,535 B2 3/2004 Dobbie et al.
D492,818 S 7/2004 Ide et al.
D495,838 S 9/2004 Arai
6,785,985 B2 9/2004 Marvin
6,826,509 B2 11/2004 Crisco, III et al.
6,874,170 B1 4/2005 Aaron
6,880,176 B2 4/2005 Timms
6,925,657 B2 8/2005 Takahashi
6,931,671 B2 8/2005 Skiba
6,934,971 B2 8/2005 Ide et al.
D509,928 S 9/2005 Barnoski
6,938,272 B1 9/2005 Brown
D511,026 S 10/2005 Ide et al.
D512,534 S 12/2005 Maddux et al.
D521,191 S 5/2006 Berger
D523,180 S 6/2006 Frye
7,062,795 B2 6/2006 Skiba
7,111,329 B2 9/2006 Stroud
7,140,049 B2 11/2006 Lang-Ree
7,146,652 B2 12/2006 Ide et al.
7,240,376 B2 7/2007 Ide et al.
7,243,378 B2 7/2007 Desarmaux
7,341,776 B1 3/2008 Milliren
D570,055 S 5/2008 Ferrara
D575,458 S 8/2008 Ho
D582,607 S 12/2008 Ferrara et al.
7,328,462 B1 12/2008 Straus
D587,407 S 2/2009 Nimmons et al.
D587,852 S 3/2009 Nimmons
D587,853 S 3/2009 Nimmons
D587,854 S 3/2009 Nimmons et al.
D587,855 S 3/2009 Nimmons et al.
D587,857 S 3/2009 Nimmons
D590,106 S 4/2009 Nimmons
D603,099 S 10/2009 Bologna et al.
D603,100 S 10/2009 Bologna
D616,154 S 5/2010 Daniel
D617,503 S 6/2010 Szalkowski
7,735,157 B2 6/2010 Ikeda
7,743,640 B2 6/2010 Lampe
7,774,866 B2 8/2010 Ferrara
7,802,320 B2 9/2010 Morgan
D625,050 S 10/2010 Chen
7,832,023 B2 11/2010 Crisco
D628,748 S 12/2010 Stewart
D629,162 S 12/2010 Daniel
7,870,617 B2 1/2011 Butler
D633,658 S 3/2011 Daniel
7,917,972 B1 4/2011 Krueger
7,930,771 B2 4/2011 Depreitere
7,954,177 B2 6/2011 Ide et al.
7,987,525 B2 8/2011 Summers
8,015,624 B2 9/2011 Baldackin
8,087,099 B2 1/2012 Sawabe
D654,227 S 2/2012 Stout
D654,629 S 2/2012 Chou et al.
D654,630 S 2/2012 Chou et al.
8,117,679 B2 2/2012 Pierce
8,156,569 B2 4/2012 Cripton
8,191,179 B2 6/2012 Durocher
8,201,269 B2 6/2012 Maddux
8,209,784 B2 7/2012 Maddux
D666,779 S 9/2012 Harris
8,296,867 B2 10/2012 Rudd
8,296,868 B2 10/2012 Belanger
D671,271 S 11/2012 Votel
D679,058 S 3/2013 Szalkowski
8,418,270 B2 4/2013 Desjardins
8,499,366 B2 8/2013 Nimmons
8,524,338 B2 9/2013 Anderson
8,544,117 B2 10/2013 Erb
8,544,118 B2 10/2013 Brine, III
8,566,968 B2 10/2013 Marzec
8,578,520 B2 11/2013 Halldin
8,656,520 B2 2/2014 Rush, III
8,707,470 B1 4/2014 Novicky
8,719,967 B2 5/2014 Milsom
8,726,424 B2 5/2014 Thomas
8,739,317 B2 6/2014 Abernethy
8,756,719 B2 6/2014 Veazie
8,793,816 B2 8/2014 Larkin
8,850,622 B2 10/2014 Finiel
8,887,312 B2 11/2014 Bhatnagar
8,887,318 B2 11/2014 Mazzarolo
8,955,169 B2 2/2015 Weber
8,966,671 B2 3/2015 Rumbaugh
9,107,466 B2 8/2015 Hoying
9,119,431 B2 9/2015 Bain
9,210,961 B2 12/2015 Torres
9,249,853 B2 2/2016 Cormier
9,277,781 B2 3/2016 Hardy
9,314,062 B2 4/2016 Marz
9,388,873 B1 7/2016 Phipps
9,462,840 B2 10/2016 Leon
9,493,643 B2 11/2016 Li
9,498,014 B2 11/2016 Wingo
9,516,910 B2 12/2016 Szalkowski
9,554,611 B2 1/2017 Arrouart
9,713,355 B2 7/2017 Daoust
9,726,249 B2 8/2017 Horstemeyer
9,750,296 B2 9/2017 Knight
9,763,488 B2 * 9/2017 Bologna ..... A42B 3/127
10,029,633 B2 7/2018 Phipps
10,085,508 B2 10/2018 Surabhi
10,130,133 B2 11/2018 Leon
10,130,134 B2 11/2018 Blair
10,136,692 B2 11/2018 Ide
10,143,255 B2 12/2018 Golnaraghi
10,149,511 B2 12/2018 Vito
10,178,889 B2 1/2019 Wacter
10,183,423 B2 1/2019 Nauman
2001/0007716 A1 7/2001 Cutler
2001/0032351 A1 10/2001 Nakayama
2002/0104533 A1 8/2002 Kalhok et al.
2002/0114859 A1 8/2002 Cutler
2002/0174480 A1 11/2002 Lombard
2003/0188375 A1 10/2003 Wilson et al.
2003/0209241 A1 11/2003 Fournier et al.
2004/0025231 A1 2/2004 Ide et al.
2004/0117896 A1 6/2004 Madey
2004/0139531 A1 7/2004 Moore
2004/0250340 A1 12/2004 Piper
2004/0255364 A1 12/2004 Feher
2004/0261157 A1 12/2004 Talluri
2005/0050617 A1 3/2005 Moore
2005/0241048 A1 11/2005 Cattaneo
2005/0278834 A1 12/2005 Lee
2006/0031978 A1 2/2006 Pierce
2006/0038694 A1 2/2006 Naunheim
2006/0059605 A1 3/2006 Ferrara
2006/0059606 A1 3/2006 Ferrara
2006/0070170 A1 4/2006 Copeland
2006/0112477 A1 6/2006 Schneider
2006/0143807 A1 7/2006 Udelhofen
2006/0179537 A1 8/2006 Dennis et al.
2006/0242752 A1 11/2006 Talluri
2007/0000032 A1 1/2007 Morgan
2007/0011797 A1 1/2007 Ikeda
2007/0094769 A1 5/2007 Lakes
2007/0157370 A1 7/2007 Joubert Des Ouches
2007/0192944 A1 8/2007 Ide et al.
2008/0052808 A1 3/2008 Leick
2008/0086916 A1 4/2008 Ellis
2008/0155734 A1 7/2008 Yen
2008/0163410 A1 7/2008 Udelhofen
2008/0172774 A1 7/2008 Ytterborn
2008/0250550 A1 10/2008 Bologna et al.
2008/0256686 A1 10/2008 Ferrara

(56) References Cited

U.S. PATENT DOCUMENTS

| | | | |
|---|---|---|---|
| 2009/0038055 | A1 | 2/2009 | Ferrara |
| 2009/0044316 | A1 | 2/2009 | Udelhofen |
| 2009/0183301 | A1 | 7/2009 | Brown |
| 2009/0222964 | A1 | 9/2009 | Wiles |
| 2009/0255036 | A1 | 10/2009 | Lim |
| 2009/0265841 | A1 | 10/2009 | Ferrara |
| 2010/0000009 | A1 | 1/2010 | Morgan |
| 2010/0005573 | A1 | 1/2010 | Rudd et al. |
| 2010/0043127 | A1 | 2/2010 | Wang |
| 2010/0180362 | A1 | 7/2010 | Glogowski |
| 2010/0258988 | A1 | 10/2010 | Darnell |
| 2010/0287687 | A1 | 11/2010 | Ho |
| 2010/0299813 | A1 | 12/2010 | Morgan |
| 2010/0319110 | A1 | 12/2010 | Preston-Powers |
| 2011/0047680 | A1 | 3/2011 | Hoying |
| 2011/0107503 | A1 | 5/2011 | Morgan |
| 2011/0131695 | A1 | 6/2011 | Maddux |
| 2011/0167541 | A1 | 7/2011 | Chilson |
| 2011/0167542 | A1 | 7/2011 | Bayne |
| 2011/0203038 | A1 | 8/2011 | Jones |
| 2011/0209272 | A1 | 9/2011 | Drake |
| 2011/0215931 | A1 | 9/2011 | Callsen |
| 2011/0225706 | A1 | 9/2011 | Pye |
| 2011/0229685 | A1 | 9/2011 | Lin |
| 2011/0271428 | A1 | 11/2011 | Withnall |
| 2012/0005810 | A1 | 1/2012 | Cheng |
| 2012/0011639 | A1 | 1/2012 | Beauchamp et al. |
| 2012/0036619 | A1 | 2/2012 | Ytterborn |
| 2012/0047635 | A1 | 3/2012 | Finiel |
| 2012/0060251 | A1 | 3/2012 | Schimpf |
| 2012/0079646 | A1 | 4/2012 | Belanger et al. |
| 2012/0096631 | A1 | 4/2012 | King |
| 2012/0151663 | A1 | 6/2012 | Rumbaugh |
| 2012/0180199 | A1 | 7/2012 | Chilson |
| 2012/0198604 | A1 | 8/2012 | Weber |
| 2012/0204327 | A1 | 8/2012 | Faden |
| 2012/0210498 | A1 | 8/2012 | Mack |
| 2012/0233745 | A1 | 9/2012 | Veazie |
| 2012/0291183 | A1 | 11/2012 | Janisse |
| 2012/0317704 | A1 | 12/2012 | Coyle |
| 2012/0317705 | A1 | 12/2012 | Lindsay |
| 2013/0000015 | A1 | 1/2013 | Marzec |
| 2013/0000017 | A1 | 1/2013 | Szalkowski |
| 2013/0000018 | A1 | 1/2013 | Rudd |
| 2013/0007950 | A1 | 1/2013 | Arai |
| 2013/0025032 | A1 | 1/2013 | Durocher |
| 2013/0040524 | A1 | 2/2013 | Halldin |
| 2013/0042396 | A1 | 2/2013 | Wehtje |
| 2013/0061371 | A1 | 3/2013 | Phipps |
| 2013/0061375 | A1 | 3/2013 | Bologna |
| 2013/0122256 | A1 | 5/2013 | Kleiven |
| 2013/0340146 | A1 | 12/2013 | Dekker |
| 2014/0007324 | A1 | 1/2014 | Svehaug |
| 2014/0020158 | A1 | 1/2014 | Parsons |
| 2014/0090155 | A1 | 4/2014 | Johnston |
| 2017/0065018 | A1 | 3/2017 | Lindsay |

FOREIGN PATENT DOCUMENTS

| | | | |
|---|---|---|---|
| DE | 8321097 | | 10/1983 |
| DE | 3338188 | | 5/1985 |
| DE | 3603234 | | 8/1987 |
| DE | 3632525 | | 3/1988 |
| DE | 19745960 | | 4/1999 |
| EP | 512193 | | 11/1992 |
| EP | 571065 | | 11/1993 |
| EP | 623292 | | 11/1994 |
| EP | 630589 | | 12/1994 |
| EP | 770338 | | 5/1997 |
| EP | 1219189 | A1 | 7/2002 |
| EP | 1388300 | | 2/2004 |
| EP | 1538935 | A1 | 6/2005 |
| EP | 1627575 | A1 | 2/2006 |
| EP | 1708587 | A1 | 10/2006 |
| EP | 1836913 | A2 | 9/2007 |
| EP | 2042048 | A2 | 4/2009 |
| EP | 2071969 | A2 | 6/2009 |
| EP | 2103229 | A2 | 9/2009 |
| EP | 2156761 | A2 | 2/2010 |
| EP | 2289360 | A2 | 3/2011 |
| GB | 256430 | | 8/1926 |
| GB | 1354719 | | 6/1974 |
| JP | 56-53735 | | 5/1981 |
| JP | 57-205511 | | 12/1982 |
| JP | 3-22024 | | 3/1991 |
| JP | 05-132809 | | 5/1993 |
| JP | 05-72922 | | 10/1993 |
| JP | 07-109609 | | 4/1995 |
| JP | 07-126908 | | 5/1995 |
| JP | 10-195707 | | 7/1998 |
| JP | 2001-020121 | | 1/2001 |
| JP | 59-37323 | | 9/2011 |
| RU | 2150874 | | 6/2000 |
| WO | WO 9534229 | | 12/1995 |
| WO | WO 9823174 | | 6/1998 |
| WO | 1999042012 | | 8/1999 |
| WO | 2000067998 | | 11/2000 |
| WO | WO 0152676 | | 7/2001 |
| WO | 2002028211 | | 4/2002 |
| WO | 2004023913 | | 3/2004 |
| WO | 2004052133 | | 6/2004 |
| WO | 2005000059 | | 1/2005 |
| WO | 2007047923 | | 4/2007 |
| WO | 2008085108 | A1 | 7/2008 |
| WO | 2010001230 | | 1/2010 |
| WO | 2011084660 | | 7/2011 |
| WO | 2011087435 | A1 | 7/2011 |

OTHER PUBLICATIONS

Schutt's Response to Riddell's First Set of Interrogatories; including patent invalidity contentions and exhibit with invalidity claim charts; dated Mar. 13, 2009.

Schutt's Answer and Affirmative Defenses; *Riddell, Inc.* v. *Schutt Sports, Inc*; U.S. District Court for the W.D. of Wisconsin; 08-cv-711; dated Feb. 16, 2009.

Plaintiff Riddell's Brief in Support of Proposed Claim Constructions; dated Apr. 29, 2009.

Declaration of Michael W. Irvin dated Aug. 30, 2012.

Schutt Photographs (Published Apr. 2001) (Exhibit 1 of Irvin Declaration).

Schutt Sports, 2002 Football Catalog (Exhibit 2 of Irvin Declaration).

Supplemental Declaration of Michael W. Irvin Under 37 CFR 1.132 and MPEP 2616 dated Dec. 27, 2012.

Rawlings Fall/Winter Sports Catalog 1926-1927.

Expert Report of Mr. Rovani filed Dec. 15, 2009, *Riddell, Inc.* v. *Schutt Sports, Inc.*; U.S. District Court for the W.D. of Wisconsin; 08-cv-711.

Plaintiff Riddell's Opinion Brief to Defendant Schutt's Proposed Claim Constructions; dated May 18, 2009.

Defendant Schutt's First Supplemental Responses to Plaintiff Riddell's First Set of Interrogatories.

Four Photographs of Riddell, Inc.'s VSR4 football helmet which was commercially available prior to May 1, 2001.

U.S. Appl. No. 10/151,245, filed May 21, 2002, Lombard.

Face-Off Lacrosse Yearbook 2003, Spring 2003, three pages, vol. 10.

Declaration of co-inventor Thad M. Ide, dated Oct. 28, 2004, 2 pages with photographs of seven (7) helmets bearing labels A1-A6, B1-B5, C1-7, D1-D5, E1-E5, F1-F5, G1-G5, 22 pages (commercially available prior to Apr. 29, 2003) see p. 2 of declaration.

Newman, James A., "A Proposed New Biochemical Head Injury Assessment Function—The Maximum Power Index", Stapp Paper No. OOS-80, 44th Stapp Car Crash Conference Proceedings-Copyright 2000 The Staff Association; published prior to (critical date) Sep. 8, 2005 (Abstract only).

Newman, James A., "A New Biochemical Assessment of Mild Traumatic Brain Injury Part 2—Results and Communications", published prior to (critical date) Sep. 8, 2005 (Abstract only).

(56) References Cited

OTHER PUBLICATIONS

Newman, James A., "A New Biochemical Assessment of Mild Traumatic Brain Injury Part 1—Methodology", published prior to (critical date) Sep. 8, 2005 (Abstract only).

* cited by examiner

FIG. 3
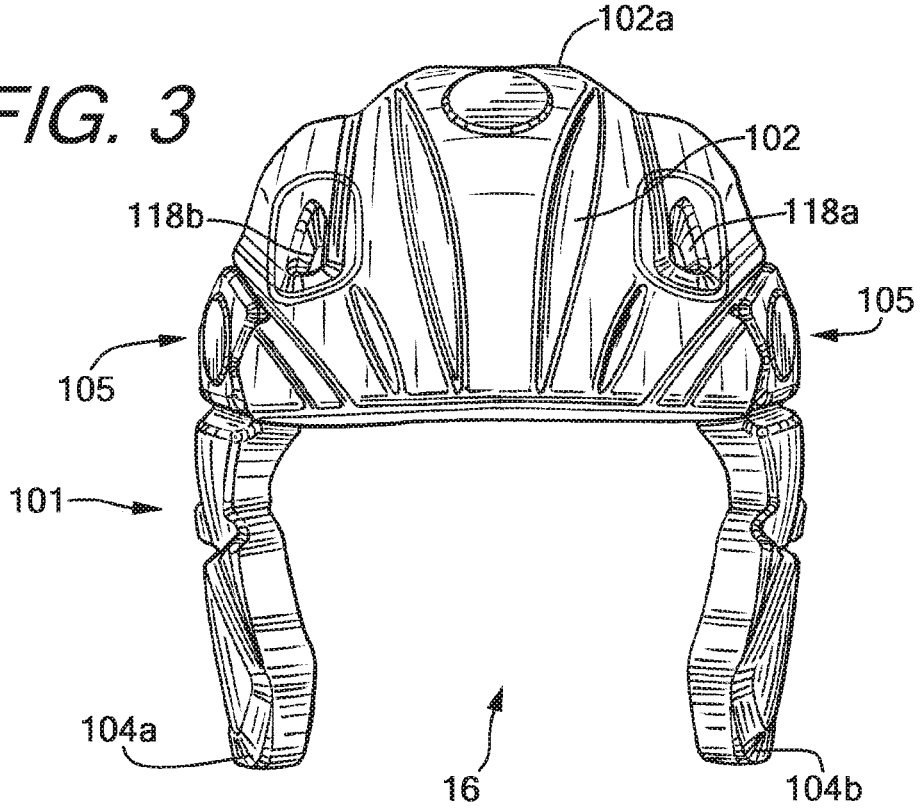
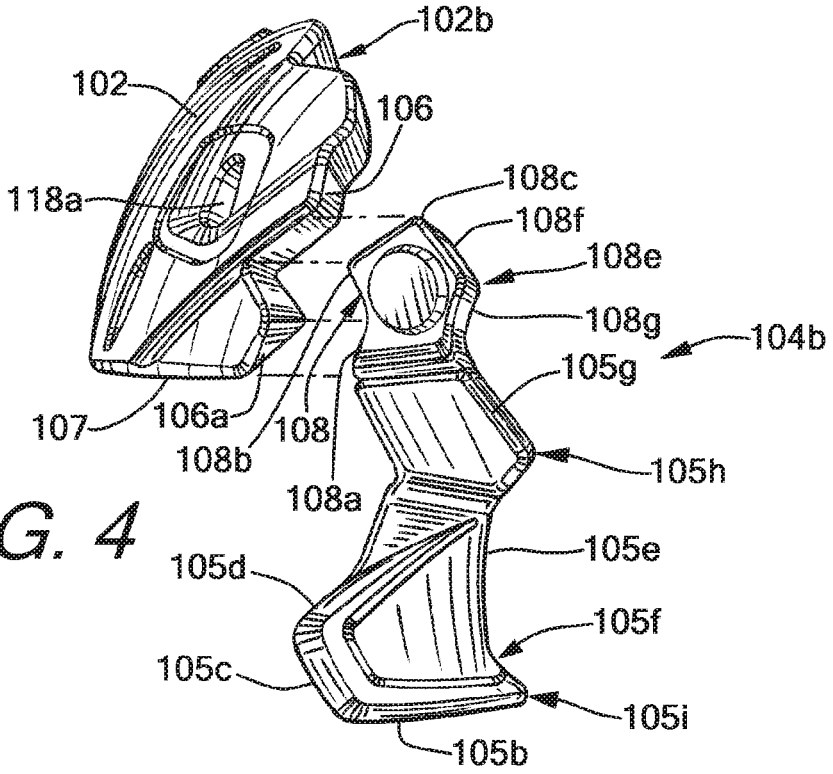
FIG. 4

FIG. 7
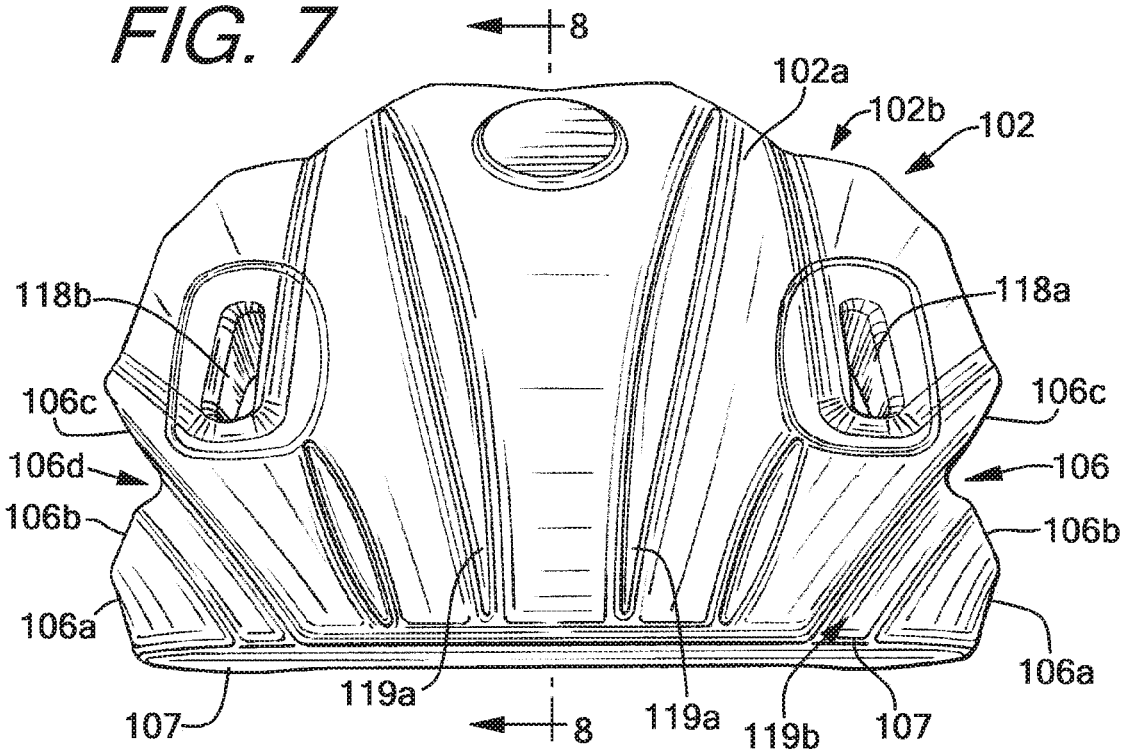
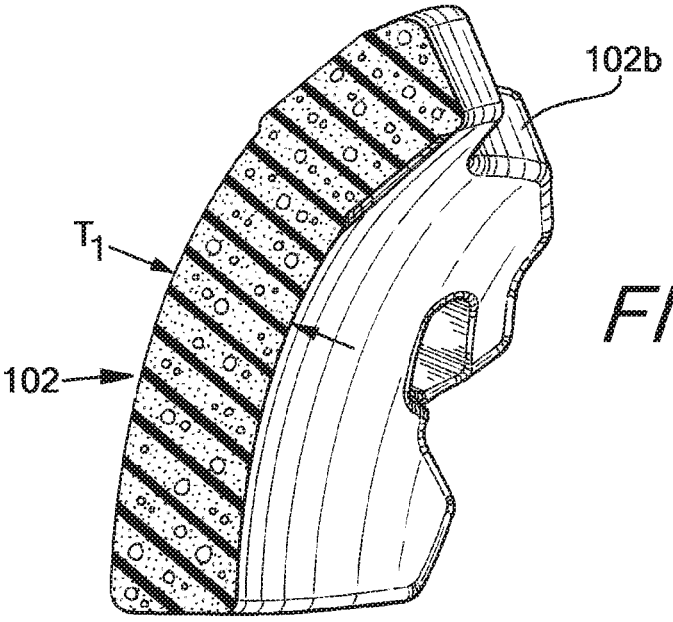
FIG. 8

PROTECTIVE SPORTS HELMET

CROSS-REFERENCE TO RELATED APPLICATIONS

This application is a continuation of co-pending U.S. patent application Ser. No. 13/229,165, filed Sep. 9, 2011, to be issued as U.S. Pat. No. 9,763,488, the disclosure of which is hereby incorporated by reference in their entirety for all purposes.

FEDERALLY SPONSORED RESEARCH OR DEVELOPMENT

N/A

TECHNICAL FIELD

The invention generally relates to a protective sports helmet, such as a football, lacrosse, hockey or baseball helmet, worn by a player during the play of a contact sport. The inventive helmet includes a number of improvements, including but not limited to a unique internal padding assembly that dissipates impact forces received by the helmet.

BACKGROUND OF THE INVENTION

Helmets for contact sports, such as those used in football, hockey and lacrosse, typically include a shell, an internal padding assembly, a faceguard or face mask, and a chin protector or strap that removably secures the helmet on the wearer's head. The internal padding assembly is secured to an interior surface of the shell to absorb a portion of energy received from a force applied to an exterior surface of the shell. Existing padding assemblies often include a plurality of padding elements that are arranged to contact a wearer's head when the helmet is worn.

Existing internal padding assemblies that are affixed to the inner surface of a football helmet often include a number of pad elements that may be formed from absorbent foam, air, gel or a combination thereof. Air may be utilized as an inflation fluid to adjust the dimensions of the pad element. An example of such a pad element is disclosed in U.S. Pat. No. 5,175,889. Another example of a helmet with an inflatable bladder is shown in U.S. Pat. No. 5,014,365. Conventional padding assemblies do not fully accommodate the anatomical distinctions among various wearer's heads, and under certain helmet impact conditions, these padding assemblies may not prevent the helmet from rotating about the wearer's head. This rotation may occur under a variety of conditions, including when the helmet's facemask is pulled, or when a player and/or helmet is subjected to a severe impact or a number of nearly simultaneous impacts.

The present invention is provided to solve these limitations and to provide advantages and aspects not provided by conventional sports helmets. A full discussion of the features and advantages of the present invention is deferred to the following detailed description, which proceeds with reference to the accompanying drawings.

SUMMARY OF THE INVENTION

The present invention is directed to a protective sports helmet that includes a number of improvements intended to increase the protective attributes of the helmet. For example, the helmet features an energy attenuating internal padding system with a face frame padding assembly comprising a brow pad and a pair of jaw pads that are cooperatively dimensioned and positioned within the helmet to frame the face of the wearer. The padding assembly also includes a unique crown pad element with an internal separation layer that partitions the pad element into a first inflatable section and a second un-inflatable section, which increases the stability of the helmet on the wearer's head. Additionally, the padding system assembly includes an occipital locking pad that contacts the occipital portion of the wearer's skull to resist forward and/or rearward rotation of the helmet when an impact(s) is applied to the helmet during the course of play of the contact sport.

While it is desirable that a protective sports helmet prevents injuries from occurring, it should be noted that due to the nature of contact sports (including football), no sports helmet, including the helmet of the present invention, can completely prevent injuries to those individuals playing sports. It should be further noted that no protective equipment can completely prevent injuries to a player, especially when the player uses the equipment improperly and/or employs poor form or technique. For example, if a football player uses the helmet in an improper manner, such as to butt, ram, or spear an opposing player (which is in violation of the rules of football), this can result in severe head and/or neck injuries, paralysis, or death to the football player, as well as possible injury to the football player's opponent. No football helmet, or protective helmet (such as that of the present invention) can prevent head, chin, or neck injuries a football player might receive while participating in the sport of football. The helmet of the present invention is believed to offer protection to football players, but it is believed that no helmet can, or will ever, totally and completely prevent injuries to football players.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 3 is a front view of a face frame padding assembly of the invention;

FIG. 4 is an exploded side view of the face frame padding assembly;

FIG. 7 is a front view of a brow pad of the face frame padding assembly;

FIG. 8 is a sectional view of the brow pad taken through line 8-8 of FIG. 7;

Figure 1:
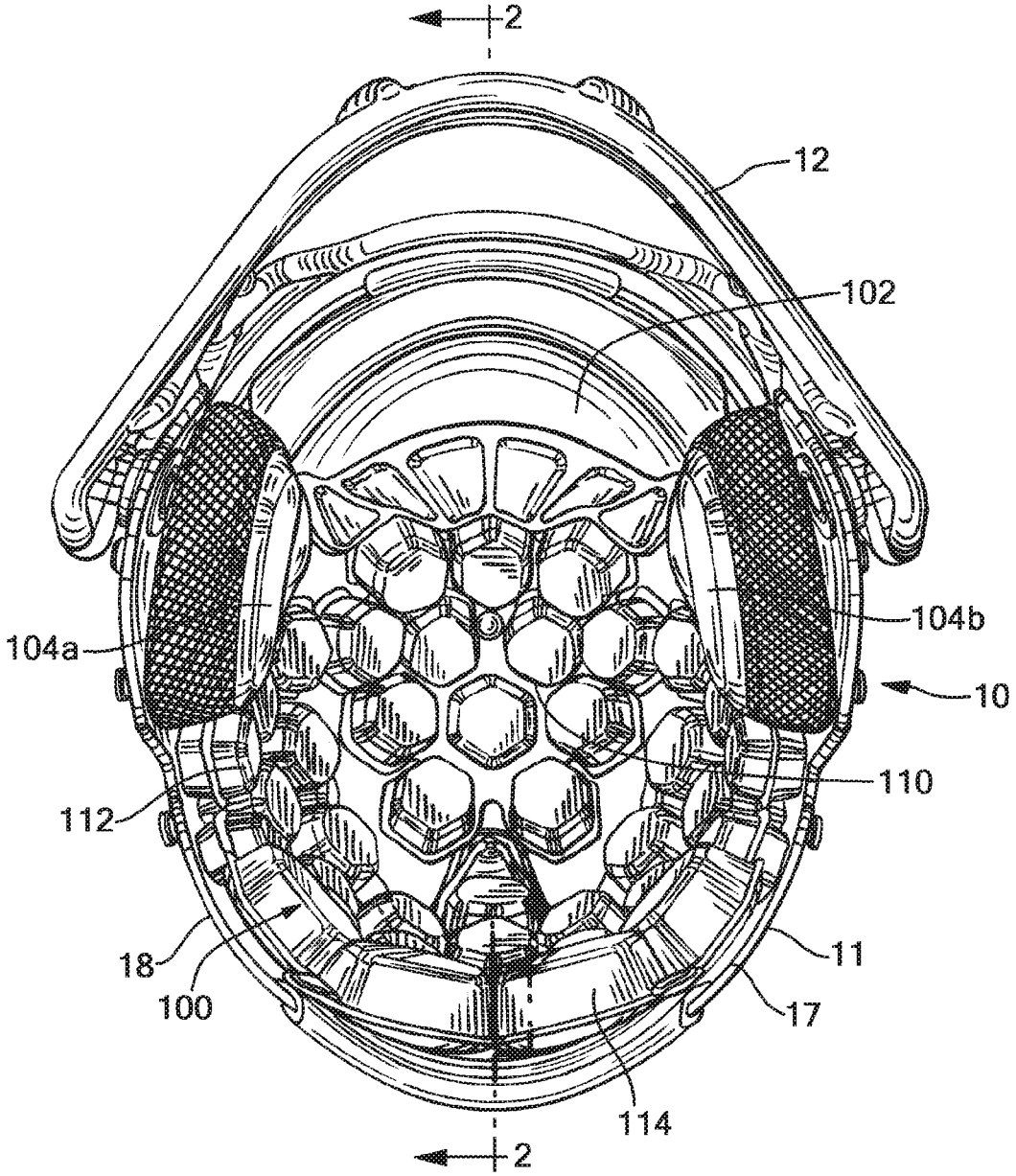
FIG. 1 is a bottom view of an embodiment of an inventive sports helmet with internal padding assembly.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2A:
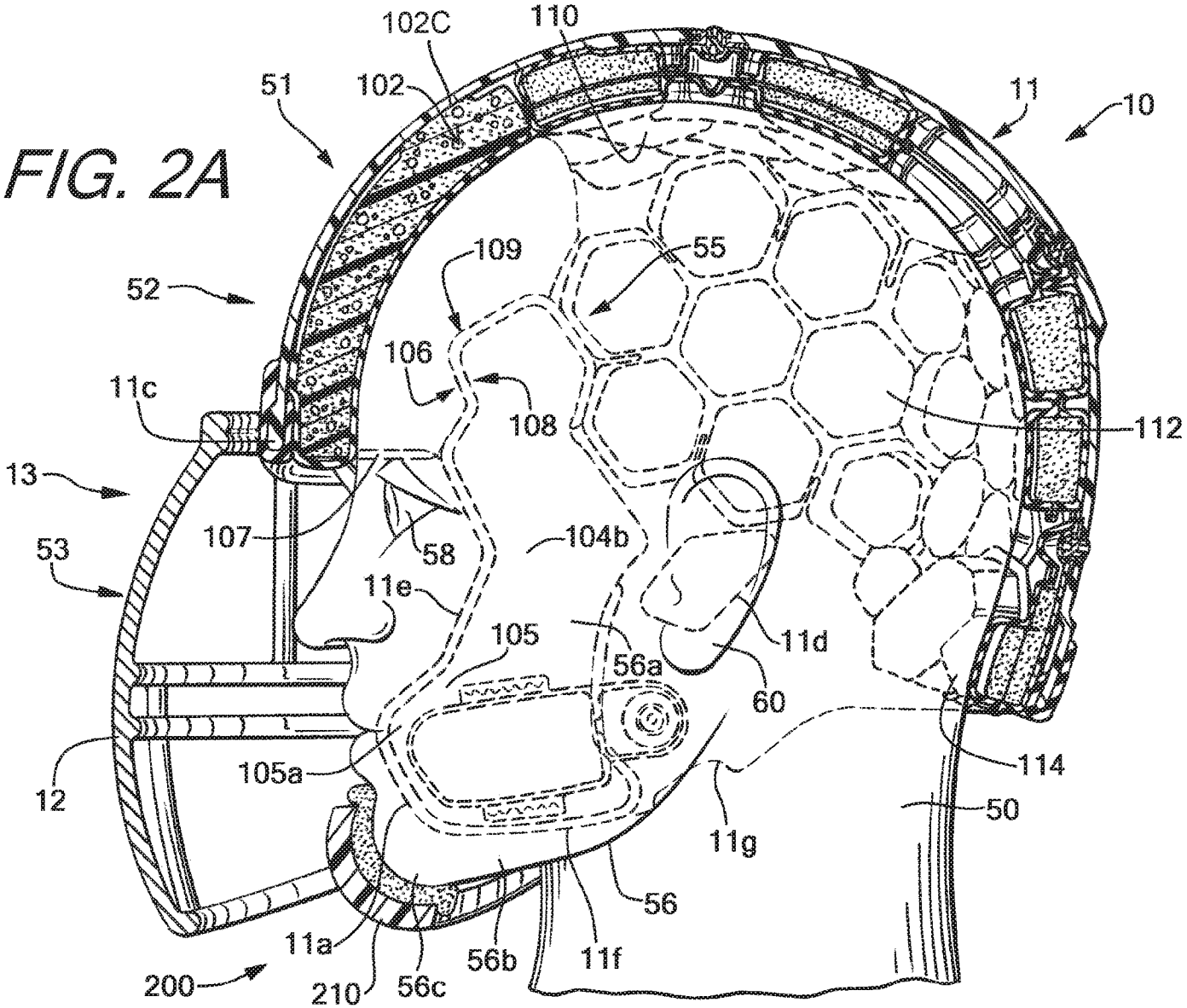
FIG. 2A is a sectional view taken through line 2-2 of the helmet of FIG. 1, including a wearer of the helmet being partially shown and padding elements of the padding assembly being shown in phantom lines.
Figure 2B:
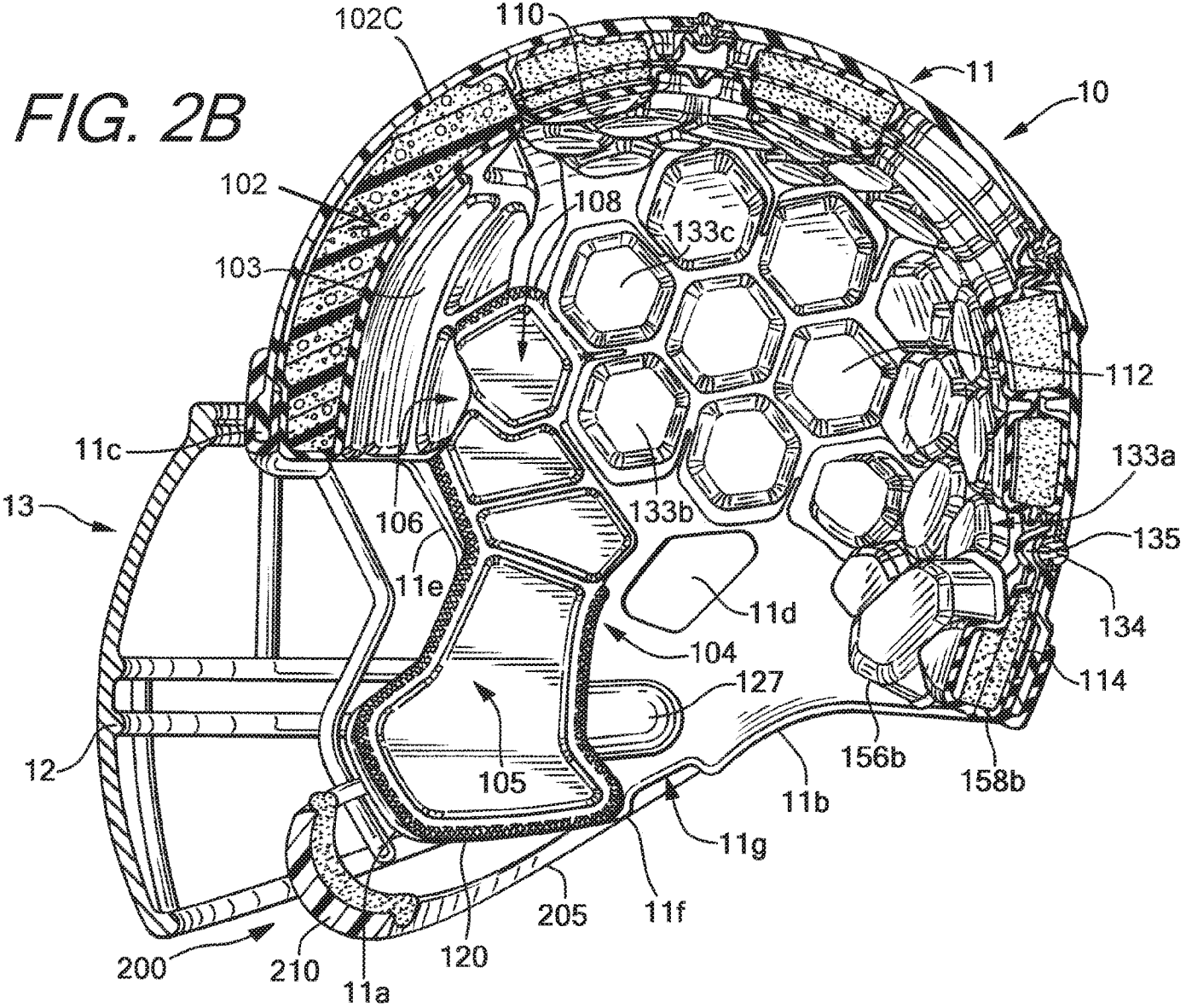
FIG. 2B is a sectional view taken through line 2-2 of the helmet of FIG. 1, including padding elements of the padding assembly being shown in phantom lines.
Figure 5:
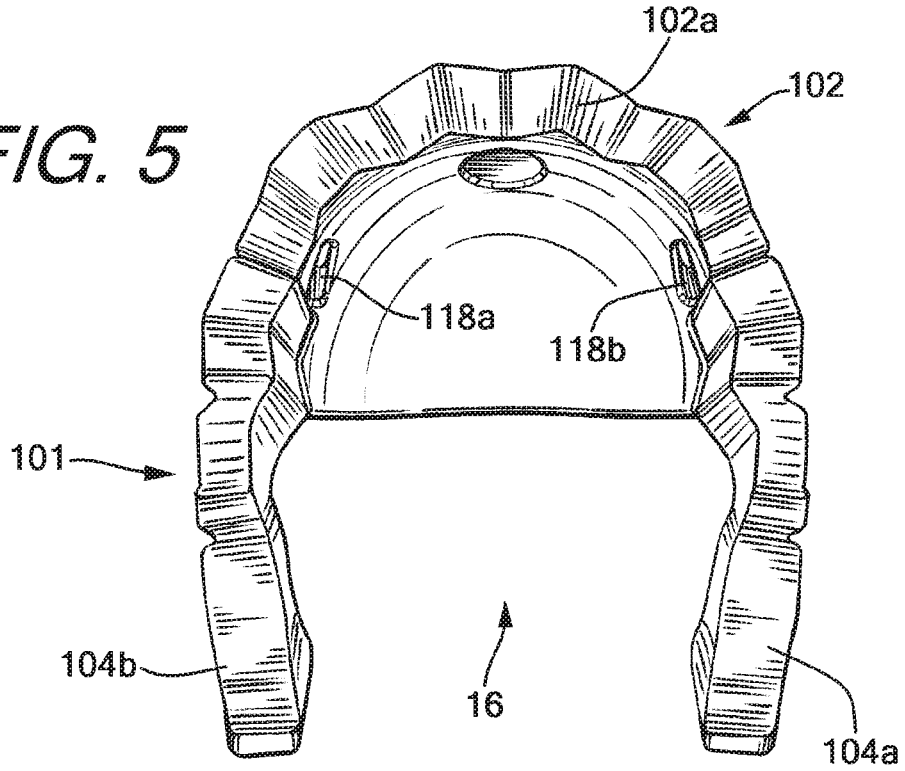
FIG. 5 is a rear view of the face frame padding assembly.

In the Figures, a football helmet 10 in accordance with the present invention is shown and that includes: an outer shell 11, a faceguard 12, and an internal padding system 100. The helmet 10, the shell 11, and the faceguard 12 are substantially similar to those disclosed in U.S. patent application Ser. No. 13/068,104 filed on May 2, 2011 which is incorporated by reference herein in its entirety. The outer shell 11 is preferably made of any suitable plastic material having the requisite strength and durability characteristics to function as a football helmet, or other type of protective helmet, such as polycarbonate plastic materials, one of which is known as LEXAN®, as is known in the art. In the connected position shown in FIGS. 1-3, the faceguard 12 is positioned adjacent to a portion of an outer surface 18 of the shell 11. Referring to FIGS. 2A and B, the faceguard 12 covers a frontal opening 13 of the shell 11 that exposes the wearer's face 53, wherein the periphery of the frontal opening 13 is defined by a frontal jaw flap edge 11*a*, a front shell edge 11*c* and a lateral shell edge 11*e* that extends between the frontal jaw flap edge 11*a* and the front shell edge 11*c*. The frontal jaw flap edge 11*a* extends upward from a lower jaw flap edge 11*f* that is substantially linear. As shown in FIG. 2B, a rear lower edge 11*b* of the shell 11 extends between opposed lower jaw flap edges 11*f*, and includes a notch 11*g* that receives an extent of a strap member 205 of a chin protector assembly 200 when the helmet 10 is secured on the wearer's head 51. As shown in FIG. 2A, the chin protector assembly 200 includes a curvilinear cup member 210 that engages the wearer's chin 56*c*.

The Figures show an internal padding system 100 which is connected to an inner surface (or wall) 17 of the helmet 10. Preferably, the internal padding system 100 is releasably connected to the inner wall surface 17 by a plurality of connector means. Preferably the connectors means includes a hook and loop fastener assembly 136, which is generally referred to as a VELCRO® attachment, as by placing the hook and loop assembly on the internal padding system assembly 100 and the inner shell surface 17. The internal padding system 100 includes a face frame pad assembly 101 comprising a brow pad 102, a first jaw pad 104*a*, and a second jaw pad 104*b* that collectively define a frontal pad opening 16 (see FIG. 3). As shown in FIGS. 2A and 2B, the brow pad 102 resides within a partial liner 103 that leaves an upper, inner extent 102*c* of the brow pad 102 exposed and in direct contact with the inner surface of the shell 11. The internal padding system 100 further includes a crown pad assembly 110, a side pad assembly 112, and an occipital cradle pad assembly 114. In general, a pad assembly, such as the crown pad assembly 110, comprises a plurality of pad elements, wherein each pad element includes at least one pad member comprised of a pad material. As discussed below, two pad members can be combined to form a single pad element.

Figure 14:
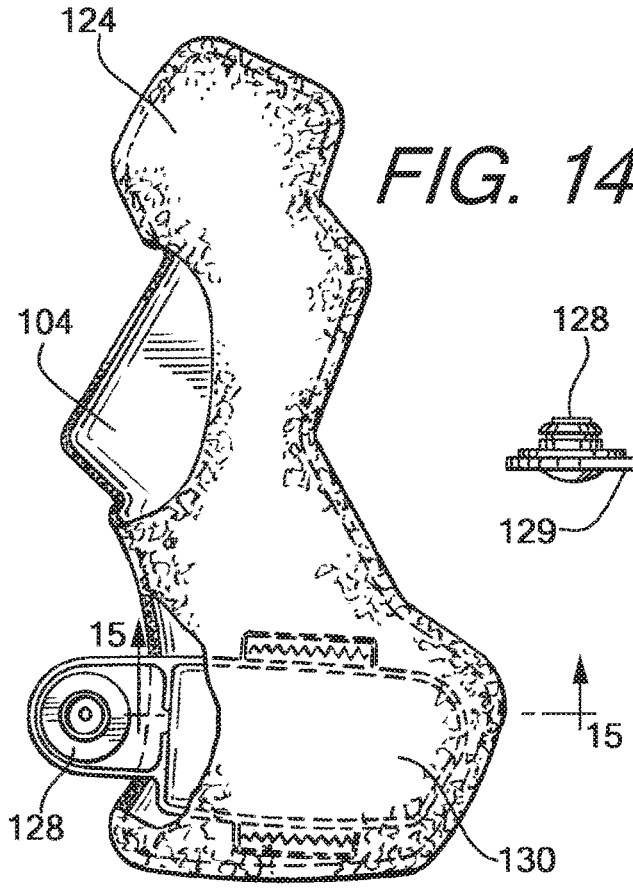
FIG. 14 is a second side view of the jaw pad of the face frame padding assembly positioned within a padding liner.
Figure 15:
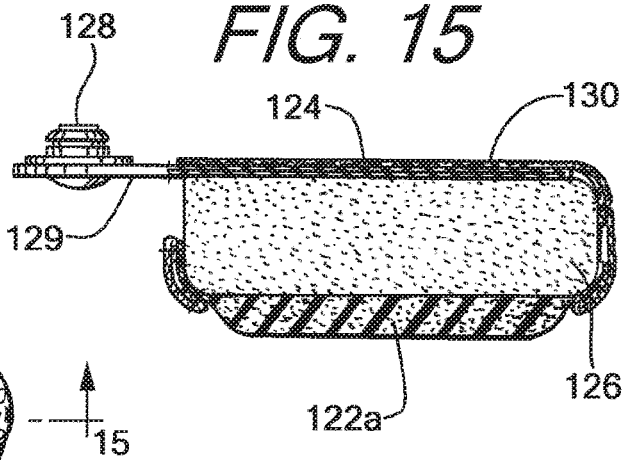
FIG. 15 is a sectional view taken through line 15-15 of FIG. 14.

When the helmet 10 is worn, the brow pad 102 mates with the jaw pads 104 to enable the face frame pad assembly 101 to engage the frontal portion 52 of the wearer's head 51 while framing the wearer's face 53. The frontal head portion 52 includes the wearer's forehead 54 and the side regions depending downward there from to both sides of the wearer's jaw 56. Due to the mating of these components, the face frame pad assembly 101 provides continuous, interacting padding engagement between both of the wearer's jaws and across the forehead 54 (see FIGS. 2 and 3), meaning without an appreciable gap, interruption or discontinuity among the brow pad 102 and the jaw pads 104. In existing protective sports helmets with conventional internal padding assemblies, there is an appreciable gap, interruption or discontinuity because the brow pad and the jaw pads are separated by a considerable distance (e.g., at least 0.25 inch) that precludes continuous, interacting padding engagement. The brow pad 102 is configured to be positioned adjacent the wearer's brow and forehead 54, while the first and second jaw pads 104*a, b* are configured to be positioned adjacent the jaw 56 of the wearer 50. The brow pad 102 extends across the forehead 54 of the wearer 50, and between the temples 55 of the wearer 50. The first and second jaw pads 104*a, b* are substantially symmetric, wherein the first jaw pad 104*a* engages the right side of the wearer's jaw 56 and the second jaw pad 104*b* engages the left side of the wearer's jaw 56. The mating between the brow pad 102 and the jaw pad 104 provides an interconnection point 109 of the face frame assembly 101, wherein the interconnection point 109 is positioned above the front shell edge 11*c*, the shell ear opening 11*d*, and the wearer's eye 58 and ear 60 (see FIG. 2). The interconnection point 109 is preferably above a horizontal chord that is aligned with the front shell edge 11*c* and extends laterally there from to divide the shell 11 into upper and lower halves. The jaw pad 104 extends upward from the wearer's jaw 56, past the front shell edge 11*c*, the shell ear opening 11*d* and the wearer's eye 58 and ear 60, to the interconnection point 109 proximate the wearer's temple 55. Preferably, the interconnection point 109 is rearward or aft of the outer corner of the wearer's eye 58 (see FIG. 2). The interconnection between the brow pad 102 and the jaw pad 104 of the inventive helmet 10 differs significantly from the internal padding assemblies taught by the prior art. For example, U.S. Pat. No. 6,934,971 discloses a side pad assembly 125 with a sling 160 having an opening 161 that physically receives an upper pad member 151 of the jaw pad assembly 135 that is inserted into and through the opening 161 (see FIGS. 14 and 15). The '971 patent teaches that the insertion through the opening 161 is required to allow the pad member 151 to be suspended from the sling 160. In contrast, neither the brow pad 102 nor the jaw pad 104 are inserted through the other pad to form the interconnection point 109. Further, the '971 patent lacks any disclosure concerning the face frame pad assembly 101, including the mating between the brow pad 102 and the jaw pad 104 that leads to interconnection, the location of said interconnection, or the structures of the brow pad 102 and the jaw pad 104 that allow for interconnection.

The lower and intermediate portions of the jaw pad 104 overlie the ramus portion 56*a* of the wearer's jaw 56, wherein the lower portion 105 has a forwardly extending segment 105*a* that overlies a significant extent of the body portion 56*b* of the wearer's jaw 56. When the helmet 10 is worn, the jaw pads 104*a, b* expose, and do not overlie, the mental protuberance or chin 56*c* of the wearer's jaw 56. The lower jaw pad portion 105 has a substantially linear lower edge 105*b*, substantially linear front edge 105*c* extending upward from the lower edge 105*b*, and an upper edge 105*d* that is inclined from the front edge 105*c*. The front edge 105*c* and the lower edge 105*b* are set back from the frontal jaw flap edge 11*a* of the shell 11, thereby exposing an inner surface of the shell 11 in that region. The lower jaw pad portion 105 also has a curvilinear rear edge 105*e* that defines a recess 105*f*. In addition to the recess 105*f*, an upper portion of the rear jaw pad 105*g* has a series of angled edges, including a rear projection 105*h* that is positioned slightly above a midpoint of the overall height of the jaw pad 104 and that is aligned with the shell ear opening 11*d*, including an upper edge of the ear opening 11*d*. The rear projection 105*h* is slightly rearward of a lowermost projection 105*i* located between the lower edge 105*b* and the recess 105*f*.

Figure 6:
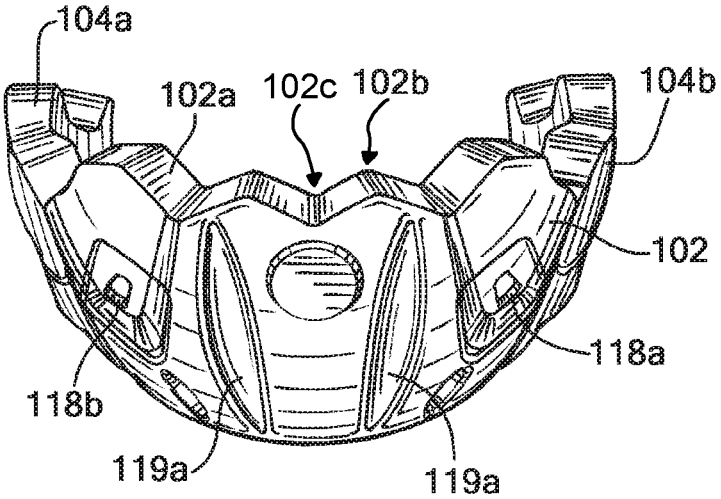
FIG. 6 is a top view of the face frame padding assembly.
Figure 9:
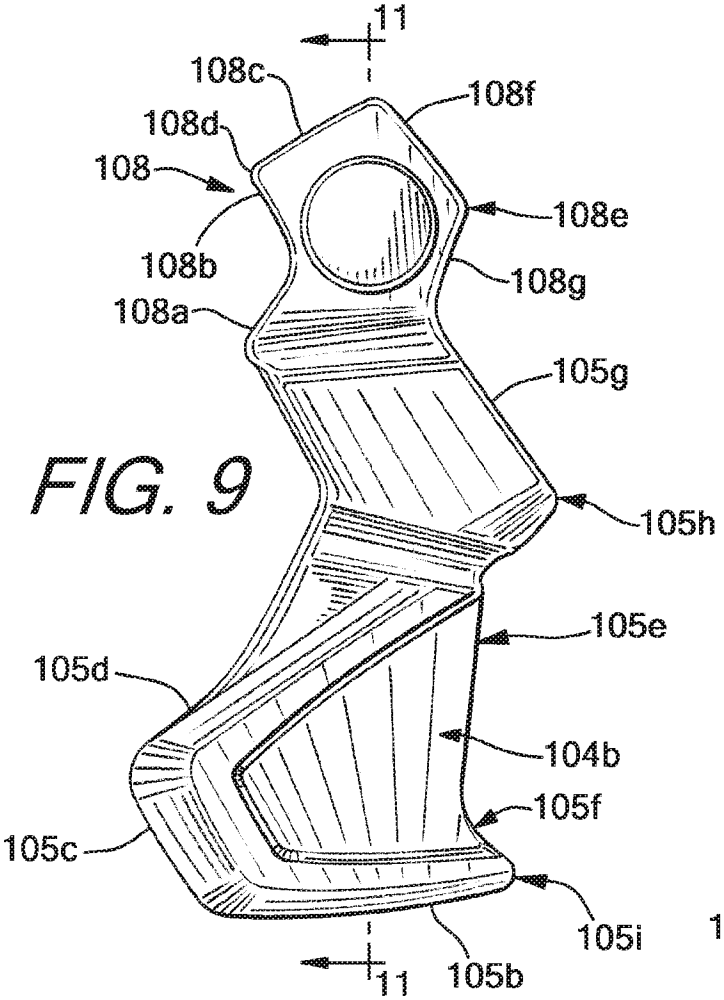
FIG. 9 is a side view of a jaw pad of the face frame padding assembly.
Figure 16:
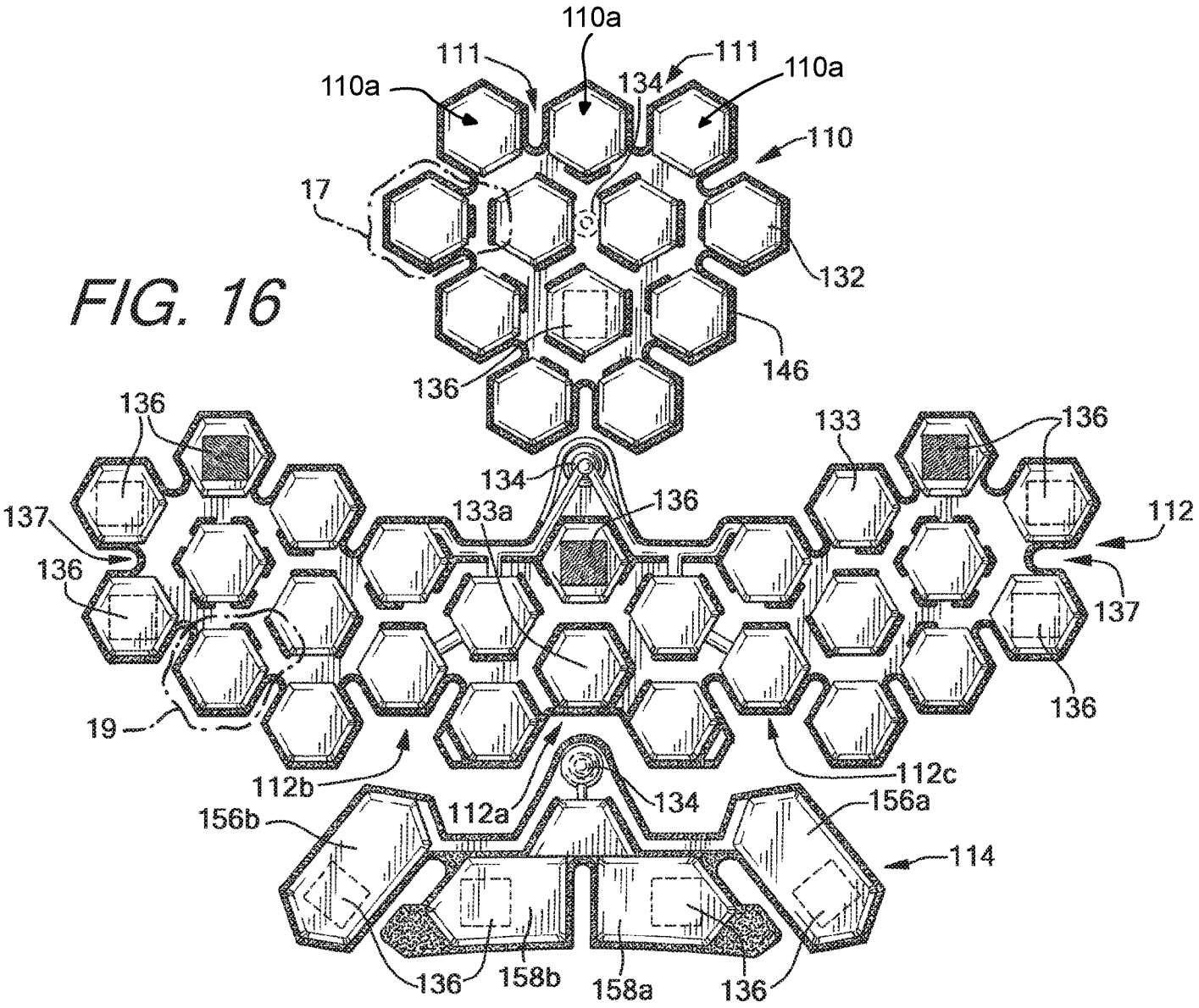
FIG. 16 is a view of a crown pad assembly, a side pad assembly, and an occipital pad assembly of the padding assembly.

As shown in FIGS. 2-15, the brow pad 102 and the jaw pad 104 have means for interconnecting to facilitate mating at the interconnection point 109. This mating at the interconnection point 109 provides continuous, interacting padding engagement between both of the wearer's jaw 56 and across the forehead 54, thereby preventing an appreciable interruption or discontinuity between the brow pad 102 and the jaw pads 104. In one embodiment, the interconnection means includes the brow pad 102 with peripheral connection portions 106 that are cooperatively dimensioned and positioned to interlock with connection portions 108 of the jaw pads 104*a, b*. Unlike conventional helmet padding assemblies that include pad elements that are adjacent or adjoining, the brow pad 102 and the jaw pad 104 feature specific structures that enables the interconnection discussed below. Preferably, the brow pad connection portion 106 is located along a lower, peripheral portion of the brow pad 102, and the jaw pad connection portion 108 is located along an upper portion of the jaw pad 104. Referring to FIGS. 2, 4 and 7, the brow pad's connection portion 106 includes a first connection segment 106 a that extends substantially rearward and upward from a lower edge 107 of the brow pad 102. A second segment 106*b* extends substantially forward and upward from the first segment 106*a* of the connection portion 106. A third segment 106*c* extends substantially rearward and upward from the second segment 106*b* of the connection portion. The first, second and third segments 106*a-c* define an arrangement of projections and at least one recess 106*d* on each periphery of the brow pad 102 (see FIG. 7). The rear edge 102*a* of the brow pad 102 extends between the opposed connections portion 106, and defines a plurality of teeth 102*b* (see FIGS. 2 and 6) that intermesh with the leading edge portion of the crown pad 110. As shown in FIGS. 1, 6, and 16, adjacent teeth 102*a* define a rear recess 102*c* that is configured to receive a extent of a frontal pad member 110*a* of the crown pad assembly 110. Referring to FIGS. 2, 4 and 9, the connection portion 108 of the jaw pad 104 includes a first connection segment 108*a* that extends substantially rearward and upward from a point on the jaw pad 104*b* that is substantially proximate the bottom edge 107 of the brow pad 102. A second segment 108*b* extends substantially forward and upward from the first segment 108*a* of the connection portion 108. A third segment 108*c* extends substantially rearward and upward from the second segment 108*b* of the connection portion 108. The first, second and third segments 108*a-c* define at least one front projection 108*d* (see FIG. 9) that is received by the recess 106*d* of the brow pad connection portion 106 in the assembled position of FIG. 2.

In an assembled position of FIGS. 2 and 3, the connection portions 106, 108 intermesh at the interconnection point 109 to facilitate engagement between the brow pad 102 and the jaw pad 104. Further, the first segment 106*a* of the brow pad 102 is disposed proximate and abuts the first segment 108*a* of the jaw pad 104*b*. In the assembled position, the lowermost point of the connection segment 108*a* is preferably adjacent the brow pad lower edge 107 and above the wearer's eye 58. The second segment 106*b* of the brow pad 102 is disposed proximate and abuts the second segment 108*b* of the jaw pad 104*b*. Likewise, the third segment 106*c* of the brow pad 102 is disposed proximate and abuts the third segment 108*c* of the jaw pad 104*b*. The interaction of the connection portion 106 of the brow pad 102 and the connection portion 108 of the jaw pads 104*a*, 104*b* limit movement there between and thereby maintain positioning between the brow pad 102 and the jaw pads 104*a*, 104*b* for the face frame assembly 101, as well as the face frame assembly 101 relative to the wearer 50.

Figure 11:
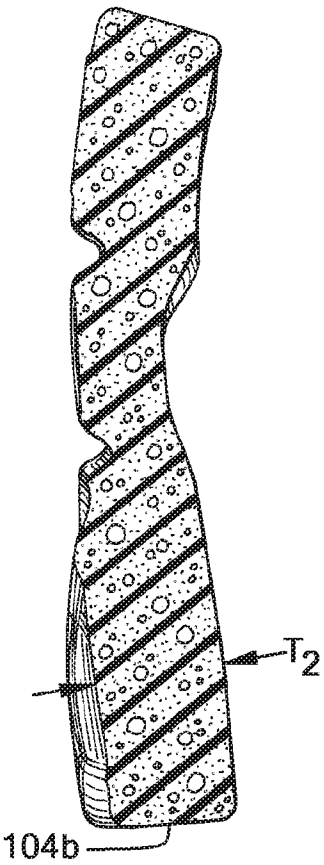
FIG. 11 is a sectional view of the jaw pad taken through line 11-11 of FIG. 9.
Figure 10:
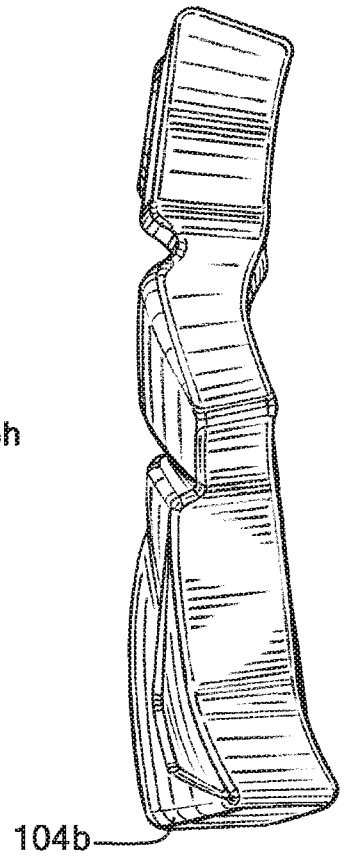
FIG. 10 is a front view of the jaw pad of the face frame padding assembly.

As shown in FIGS. 8 and 11, the brow pad 102 and the jaw pads 104 are each made from a single type of padding material. Preferably, each of the brow pad 102 and the jaw pads 104 are molded as a single, unitary pad. Thus, the brow pad 102 is molded to form a single piece, and the jaw pad 104 is molded to form a single piece. In one embodiment the brow pad 102 and the jaw pads 104 are injection molded. In another embodiment, the jaw pad 104 is formed from at least two portions that are molded and positioned adjacent each other, thereby precluding an appreciable interruption or discontinuity between the portions. In this embodiment, the jaw pad 104 has a substantially uniform thickness at the region where the portions are adjacently positioned and over the length of the jaw pad 104. In the event the jaw pad 104 comprises multiple injection molded portions, the resulting jaw pad 104 mates with the brow pad 102 at the interconnection point 109, as described above. An example of the material used to form the brow pad 102 is DER-TEX SHOXS IV and having a 25% compression deflection (ASTM D-1056 standard) of 8-15 PSI (pounds per square inch) from DER-TEX Corp. of Saco, Me. The brow pad 102 has a substantially uniform thickness $T_1$ of from about 1 inch to about 1.25 inches, as shown in FIG. 8. The thickness of the brow pad 102 exceeds the thickness of the helmet shell 11, as shown in FIGS. 2A and 2B. Similarly, the jaw pads 104 may also be made from DER-TEX SHOXS IV from DER-TEX Corp. of Saco, Me. The jaw pads 104 have a thickness $T_2$ of from about 1 inch to about 1.25 inches, as shown in FIG. 11.

Referring to FIGS. 3 and 7, the brow pad 102 has a plurality of vent openings 118*a*, 118*b*. In the installed position of FIG. 2, each brow pad opening 118*a*, 118 *b* is aligned with an opening in the helmet shell 11. The alignment of the vent openings 118*a*, 118*b* with the helmet shell openings allows warm air to vent or escape from the helmet 10, to increase the comfort of the wearer 50. Referring to FIG. 7, a pair of internal channels 119*a* extend from an intermediate portion of the lower edge 107 to the rear edge 102*a*, and a pair of peripheral channels 119*b* extend from a peripheral portion of the lower edge 107 to the peripheral edge of the brow pad 102, preferably proximate the notch 106*d*. Preferably, the brow pad 102 has a curvilinear configuration, and the channels 119*a, b* facilitate flexing of the brow pad 102.

Figure 12:
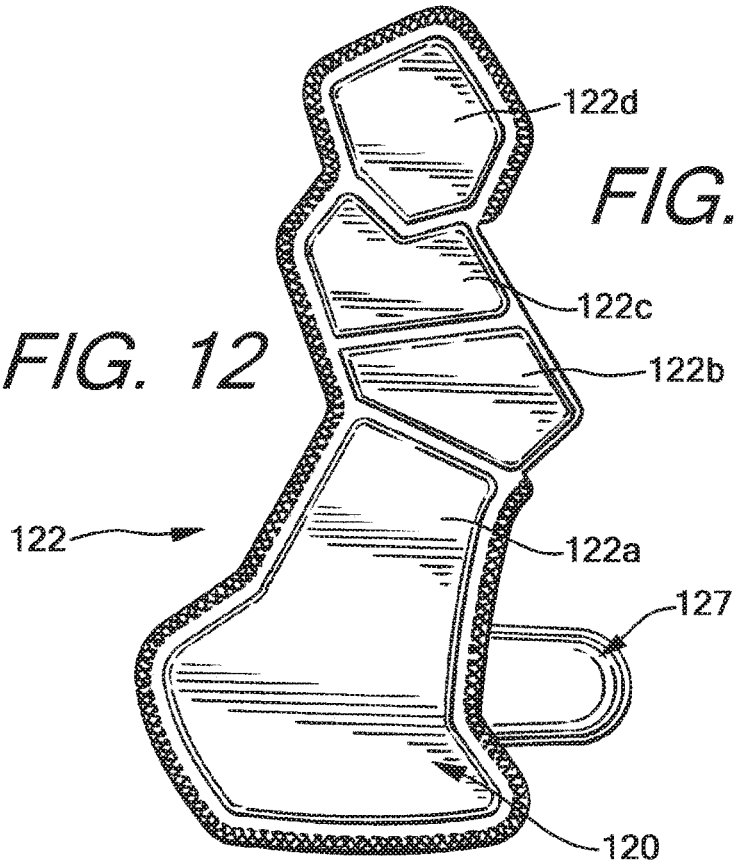
FIG. 12 is a first side view of the jaw pad of the face frame padding assembly positioned within a padding liner.
Figure 13:
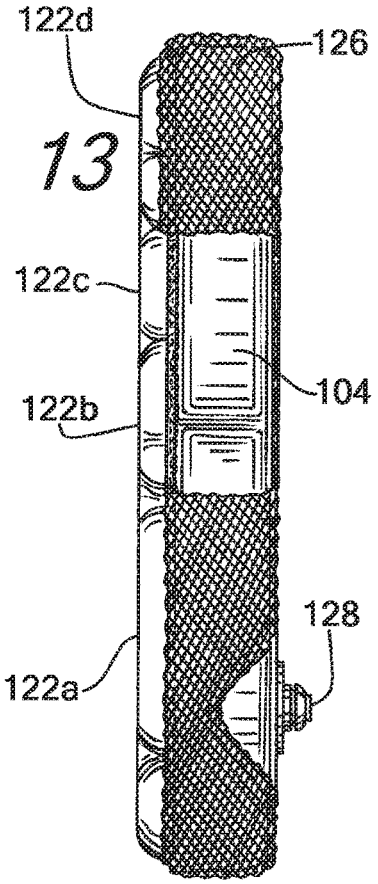
FIG. 13 is an end side view of the jaw pad of the face frame padding assembly positioned within a padding liner.

As shown in FIGS. 12-15, the jaw pad 104 is removably positioned within a liner assembly 120. Preferably, the liner assembly 120 is treated with an anti-bacterial and/or antifungal application and is washable. The liner assembly 120 comprises at least one cushioning pad 122, preferably a plurality of cushioning pads 122*a*-122*d* (FIGS. 12 and 13). The cushioning pad 122 generally comprises a material that engages the wearer 50 and is softer than the material used to form the jaw pad 104*b*. The cushioning pad 122 may therefore be referred to as a comfort padding, while the jaw pad 104*b* may be referred to as an energy attenuating padding. The liner assembly 120 also comprises a backing material 124, opposite the cushioning pad 122 that engages the inner surface of the helmet shell 11. The backing material 124 may be connected to the cushioning pad 122 by a mesh fabric 126 that engages side portions of the jaw pad 104. The liner assembly 120 includes means for inflation 127 to offer a more customized fit and to account for anatomical differences among wearers 50. Inflation means 127 includes an inflation valve and stem assembly 128 that is in fluid communication with an inflatable chamber 130 positioned between the backing material 124 and the jaw pad 104. The inflatable chamber 130 is adapted to receive a fluid, typically air, supplied through a channel 129 by the inflation valve 128, which extends through an opening in the helmet shell 11. As the inflatable chamber 130 expands, the jaw pad 104 is displaced inward from the helmet shell 11 and towards the wearer 50 of the helmet 10. Thus, a more secure and customized fit may be achieved by the use of the inflation means 130. A conventional hand held pump having an inflation needle may be inserted into the inflation valve 128 to provide the desired amount of fluid, or air, into the chamber 130.

Turning to FIGS. 16-20, the crown pad assembly 110, the side pad assembly 112, and the occipital cradle pad assembly 114 are shown removed from the helmet 10. The crown pad assembly 110 comprises a plurality of discrete hexagonal pad elements 132 that are spaced apart but interconnected by intervening connection segment 146. Because the pad elements 132 are discontinuous from each other, the pad elements 132 behave independently during use of the helmet 10—the response of a first pad element 132 to an impact force applied to the helmet 10 does not influence the response of a second pad element 132 to the impact force. Due to their hexagonal configuration and relative positioning, the leading portions of adjacent pad elements 132 of the crown pad assembly 110 define a group of crown recesses 111 (see FIG. 16) that are configured to engage with the teeth 102*b* (see FIG. 6) of the rear portion of the brow pad 102. Accordingly, the brow pad 102 has three portions—the rear portion and both side portions—that engage with other pads of the internal padding system 100. The rear portion of the brow pad 102 engages the crown pad assembly 110, while the side portions engage the jaw pads 104*a*, 104*b*.

Figure 18:
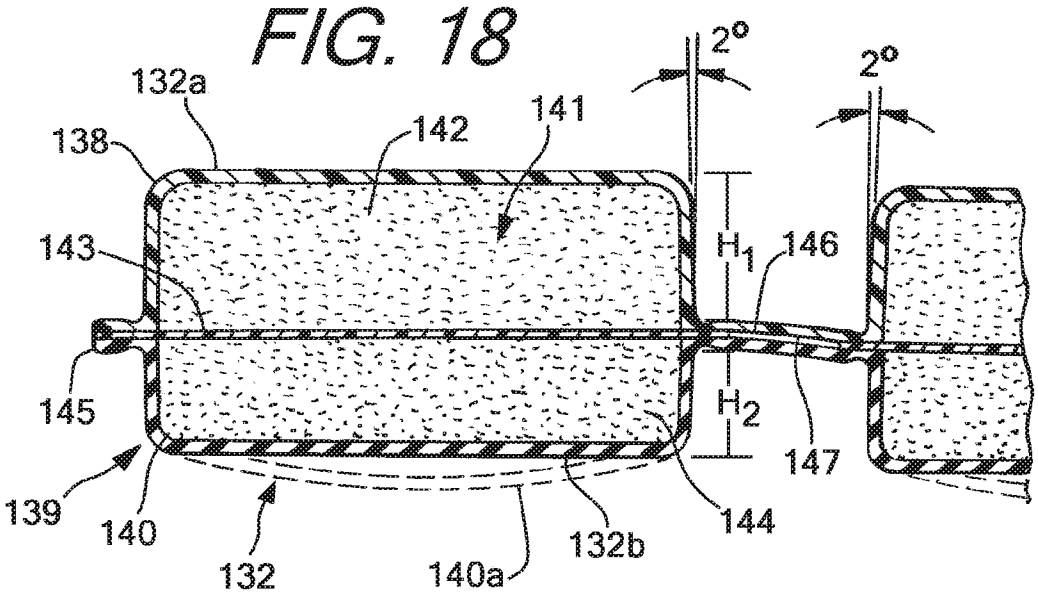
FIG. 18 is a sectional view of the pad element taken through line 18-18 of FIG. 17.
Figure 17:
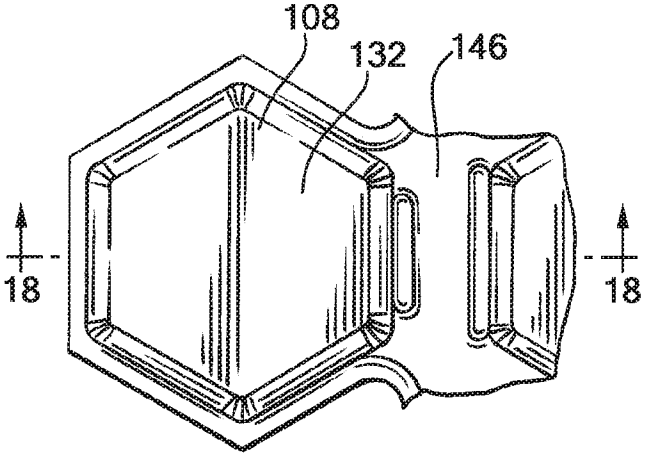
FIG. 17 is a detailed view of a pad element of the crown pad assembly.

The crown pad assembly 110 further comprises means for inflation including an inflation valve 134 to customize the fit of the crown pad assembly 110. The inflation valve 134 is adapted to provide an inflation fluid, such as air, to a portion of the hexagonally shaped pad elements 132. Referring to FIGS. 17 and 18, the hexagonal pad element 132 comprises a first housing portion 138 and a second housing portion 140 that are joined to form a housing enclosure 139 that encases a pad member 141. The pad member 141 comprises energy (or force) attenuating pad material 142 that resides within the first housing portion 138 and energy (or force) attenuating pad material 144 that resides within the second housing portion 140. The energy attenuating pad material 142 is preferably a PVC nitrile foam or polyurethane foam, such as DerTex VN 600 PVC nitrile foam, having a density of at least approximately 5 pounds per cubic foot (PCF) and at least approximately a 25% compression deflection (ASTM D-1056 standard) of 8 pounds per square inch (PSI). In another embodiment, the pad material 142 is a "comfort pad material," which is substantially different than energy attenuating pad material and is described in U.S. Pat. No. 3,882,547. A separation layer 143 is positioned between the two pad materials 142, 144 and extends between opposed seams 145 formed from joining side walls of the housing portions 138, 140. In one embodiment, the separation layer 143 has a thickness of 0.01 inch. The separation layer 143 is formed from an airtight material, such as vinyl, that partitions or separates the pad element 132 into a first chamber (or section) 132*a* including the housing portion 138 and the pad material 142, and a second chamber (or section) 132*b* including the housing portion 140 and the pad material 144. Thus, the pad element 132 is internally partitioned to include an inflatable second chamber 132*b* and an uninflatable first chamber 132*a*. Although only the crown pad assembly 110 is shown as having a partitioned pad element 132 resulting from the separation layer 145, it is understood that the separation layer and partitioning could be employed with the elements of the side pad assembly 112 and the occipital cradle pad assembly 114.

As demonstrated by the different hatching lines in FIG. 18, the first and second housing portions 138, 140 are fabricated from different materials having dissimilar material properties, thereby combining to affect how the pad element 132 responds when an impact is applied to the helmet shell 11 and transmitted to the crown pad assembly 110. In one preferred embodiment, the first housing portion 138 is vacuum formed from a first type of vinyl, while the second housing portion 140 is vacuum formed from second type of vinyl. A vacuum forming process can be employed to fabricate the first and second housing portions 138, 140 from sheet stock to create a well that accommodates the pads 142, 144, respectively. From there, the first and second housings 138, 140 are sealed to form a seam 145 of the hexagonal pad element 132, wherein the separation layer 143 extends between opposed seams 145. The first and second housings 138, 140 are joined through heat sealing process such as high frequency welding, such as radio frequency welding. As shown in FIG. 18, the first housing 138 has a sidewall height H1 that exceeds a sidewall height H2 of the second housing 140. This means that the seam 145 and the separation layer 143 are offset from a midpoint of the overall sidewall height of the pad element 132. In one embodiment, the first sidewall height H1 is 0.75 inch and the second sidewall height H2 is 0.5 inch. Because of these different sidewall heights H1, H2, the first chamber 132*a* has a greater volume than the second chamber 132*b* in an un-inflated state. As mentioned above, the connection segment 146 resides between hexagonal pad elements 132. The connection segment 146 includes an upper portion formed from the same sheet stock material as the first housing 138 and a lower portion formed from the same stock sheet material as the second housing 140. The connection segment 146 also includes a channel 147 extending between adjacent pad elements 132.

To adjust the fit of the crown pad 110, inflation fluid from the valve 134 can be supplied through the channel 147 to the second chamber 132*b* of the various pad elements 132, As denoted by the dotted lines, the lower portion of FIG. 18 shows the second chamber 132*b* in an inflated state, wherein inflation fluid has been supplied through the channel 147 to the second chamber 132*b* that is adjacent the inner surface 17 of the shell 11 when the crown pad 11 is installed within the helmet 10. When sufficiently inflated, the housing 140*a* of the second chamber 132*b* assumes a curvilinear configuration that substantially conforms to the curvilinear configuration of the inner shell surface 17 (see FIG. 18). Because the separation layer 143 is airtight, the first chamber 132*a* does not inflate and its housing 138 is not altered (e.g., curved or domed due to inflation) and remains generally linear, whereby a greater amount of the pad material 144 in the first chamber 132*a* remains in contact with the wearer's head 51. These attributes of the pad elements 132 improve both the fit of the crown pad 110 and the padding assembly 100 relative to the wearer's head 51, and the stability of the helmet 10 on the wearer's head 51, including when impact forces are applied to the helmet shell 11 and/or the faceguard 12. The channel 147 in the pad element connection section 146 allows inflation fluid to pass between various pad elements 132 for inflation or deflation of the second chamber 132*b*.

Figure 20:
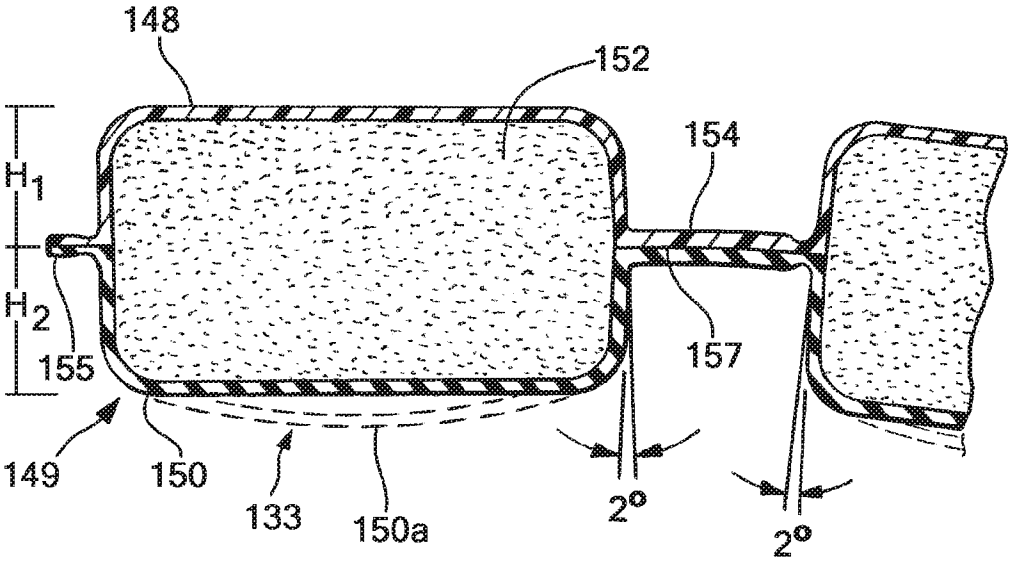
FIG. 20 is sectional view of the pad element taken through line 20-20 of FIG. 19.
Figure 19:
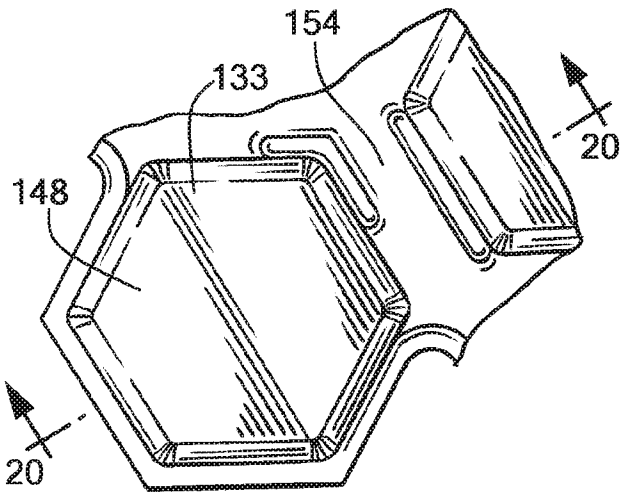
FIG. 19 is a detailed view of a pad element of the side pad assembly.

FIGS. 16, 19 and 20 show the side pad assembly 112 of the internal pad assembly 100, which also includes a plurality of discrete hexagonal pad elements 133. The side pad assembly 112 also includes an inflation valve 134 to supply inflation fluid through a channel 134*a* to the hexagonally shaped pad elements 133. The pad elements 132 are spaced apart but are interconnected by an intervening connection segment 154. The pad element 133 comprises a first housing portion 148 and a second housing portion 150 that are joined from a housing 149 that encase a pad member 152. Although the pad member 152 is shown as being formed from a single type of material, the pad member 152 could be formed from two material types (as explained above). Thus, the pad member 152 could include energy attenuating pad material, comfort pad material, or a combination of both. Referring to the different hatching lines in FIG. 20, the first and second housing portions 148, 150 are fabricated from different materials having dissimilar material properties, thereby altering how the pad element 133 responds when an impact is applied to the helmet shell 11 and transmitted to the side pad assembly 112. In one embodiment, the first housing portion 138 is fabricated from a first type of vinyl, while the second housing portion 140 is fabricated from a second type of vinyl. As explained above, a vacuum forming process can be employed to seal the first and second housings 148, 150 at a seam 155. As shown in FIG. 20, the first housing 148 has a sidewall height H1 that is substantially the same as a sidewall height H2 of the second housing 150. Therefore, the seam 155 is located at a midpoint of the overall sidewall height of the pad element 133. The connection segment 154 also includes a channel 157 extending between adjacent pad elements 133. To adjust the fit of the side pad 112, inflation fluid from the valve 134 can be supplied through the channel 157 to the various pad elements 133. The lower portion of FIG. 20 shows a second housing 150*a* in an inflated position, wherein inflation fluid has been supplied through the channel 157 to the pad element 152 that is adjacent the wearer 50. The inflation of the pad element 133 provides a more precise fit of the side pad assembly 112 on the wearer 50 while accommodating the wearer's anatomical differences. Referring to FIGS. 2B, 9 and 16, a first leading pad element 133*b* and a second leading pad element 133*c* define a cavity 137 (see FIG. 16) configured to receive a rear projection 108*e* formed from a first rear segment 108*f* and a second rear segment 108*g* of the connection portion 108 of the jaw pad 104. As shown in the assembled position of FIG. 2B, the rear projection 108*e* is received by the cavity 137 wherein the first rear segment 108*f* is positioned adjacent the first leading pad element 133*b* and the second rear segment 108*g* is positioned adjacent the second leading pad element 133*c*. Accordingly, the connection portion 108 is positioned between the crown pad 110 and the brow pad 102, and provides for mating of the jaw pad 104 with both the crown pad 110 and the brow pad 102.

Figure 21:
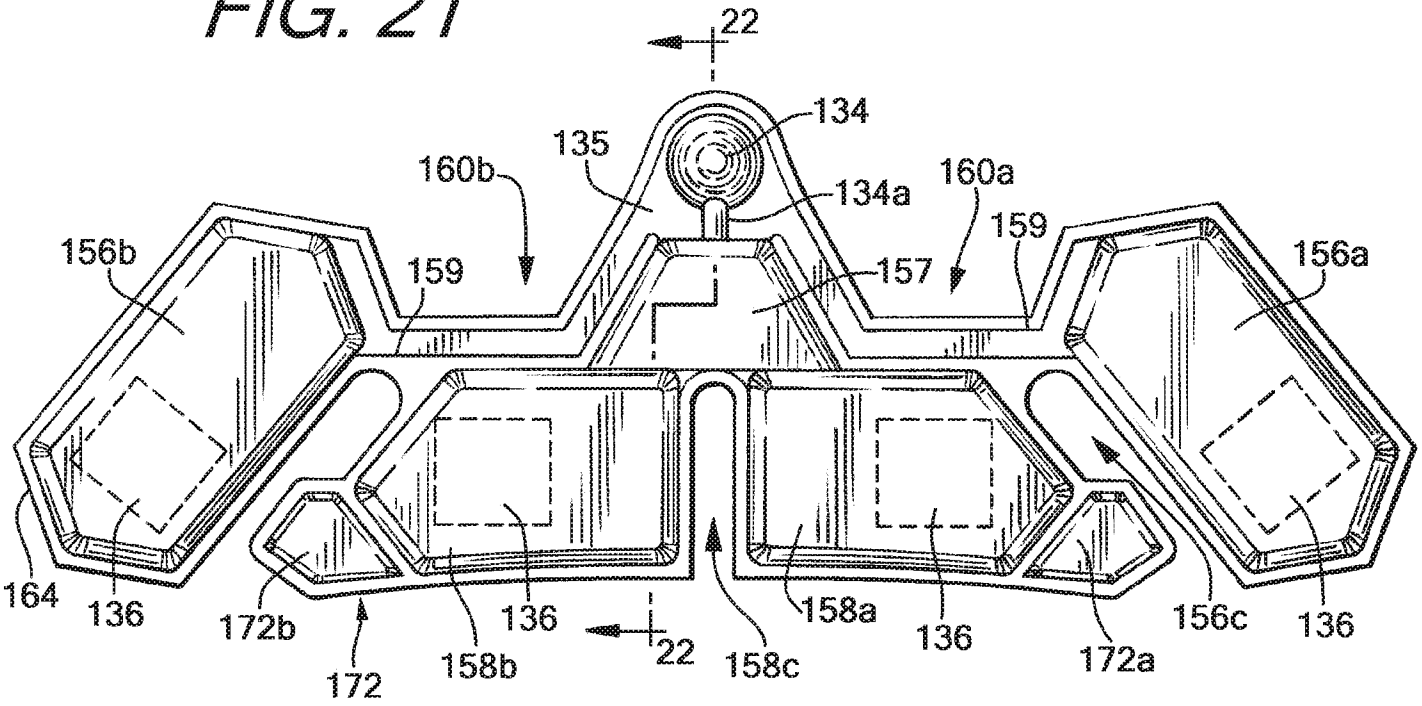
FIG. 21 is a front view of the occipital pad of the padding assembly.

FIGS. 16 and 21-23 depict the inflatable occipital cradle pad assembly 114 which, as explained below, fills the space or void V (see FIGS. 22 and 23) below the wearer's occipital protuberance 57 of the occipital bone to cradle and stabilize the helmet 10 on the wearer's head 51. When installed within the shell 11, the occipital pad assembly 114 extends along the rear lower edge 11*b* of the shell 11, wherein no other pad element resides between the occipital pad assembly 114 and the rear lower edge 11*b*. The occipital pad assembly 114 structurally and functionally interacts with the side pad assembly 112 to increase helmet 10 stability during playing of the contact sport, including when the helmet 10 receives an impact or a series of impacts, both of which are common during the play of football, lacrosse and hockey. The occipital pad assembly 114 comprises an arrangement of pad elements that are specifically designed to engage the lower extent of the occipital protuberance 57 of wearer's head 51. The occipital cradle pad assembly 114 comprises a first peripheral pad element 156*a*, a second peripheral pad element 156*b*, a central pad element 157, a first intermediate pad element 158*a* and a second intermediate pad element 158*b*. In the embodiment shown, the first and second peripheral pad elements 156*a, b* have a hexagonal configuration, the central pad element 157 has a trapezoidal configuration, and the first and second intermediate pad elements 158*a, b* have a pentagonal configuration. The first and second intermediate pad elements 158*a, b* reside adjacent or below the central pad element 157 and are separated by a central gap 158*c* that extends from a lower edge of the intermediate pad elements 158 to the central pad element 157. The first and second peripheral pad elements 156*a, b* extend outward or peripherally from a main portion of the pad assembly 114 by a connection segment 159. The first and second peripheral pad elements 156*a, b* extend transversely upward past the intermediate pad element 158*a, b* and slightly beyond the central pad element 157. A peripheral slot 156*c* extends transversely between the peripheral pad segment 156*a, b* and the intermediate pad element 158*a, b*, and from the lower edge to the connection segment 159. In the embodiment of FIG. 21, the peripheral slot 156*c* has an initial slot segment leading to an interior slot segment, wherein the width of the latter exceeds the width of the former. The gap 158*c* and the peripheral slots 156*c* facilitate flexing of the occipital cradle pad assembly 114 during installation within the helmet shell 11 and proper positioning of the pad assembly 114 relative to the helmet shell 11.

The occipital cradle pad assembly 114 also comprises an inflation valve 134 residing in an elevated portion 135 of the assembly 114. The inflation valve 134 is adapted to provide an inflation fluid, such as air, to the pad elements 156, 158. An air channel 134*a* extends from the valve 134 to the pad elements 156, 158. The occipital cradle pad assembly 114 is removably secured to the inner surface 17 of the helmet shell 11 by a connector, such as Velcro® connector 136. The occipital cradle pad assembly 114 is symmetric about an axis extending through the inflation valve 134 whereby the assembly 114 has first (right) and second (left) portions. A portion of the elevated portion 135, the first peripheral element 156*a*, the central pad element 157 and the first intermediate element 158*a* define a first well 160*a*. Similarly, the elevated portion 135, the second peripheral element 156*b* and the second intermediate element 158*ba* define a second well 160*b*. The combination of the elevated portion 135, the wells 160*a, b* and the upper portion of the peripheral pad elements 156*a, b* provide a series of projections and recesses that facilitate engagement of the occipital pad assembly 114 with a lower portion (or trailing edge portion) of the side pad assembly 112. As shown in FIG. 16, the lower portion of the side pad assembly 112 has a central recess 112*a* that receives the central elevated portion 135, and a pair of intermediate recesses 112*b, c* wherein each recess 112*b, c* receives an upper extent of the peripheral pad element 156*a,b*. When the occipital cradle pad assembly 114 and the side pad assembly 112 are installed in the helmet 10, the central elevated portion 135 is positioned between the helmet shell 11 and the pad element 133*a* of the side pad assembly 112 adjacent (see FIG. 16).

Figure 22:
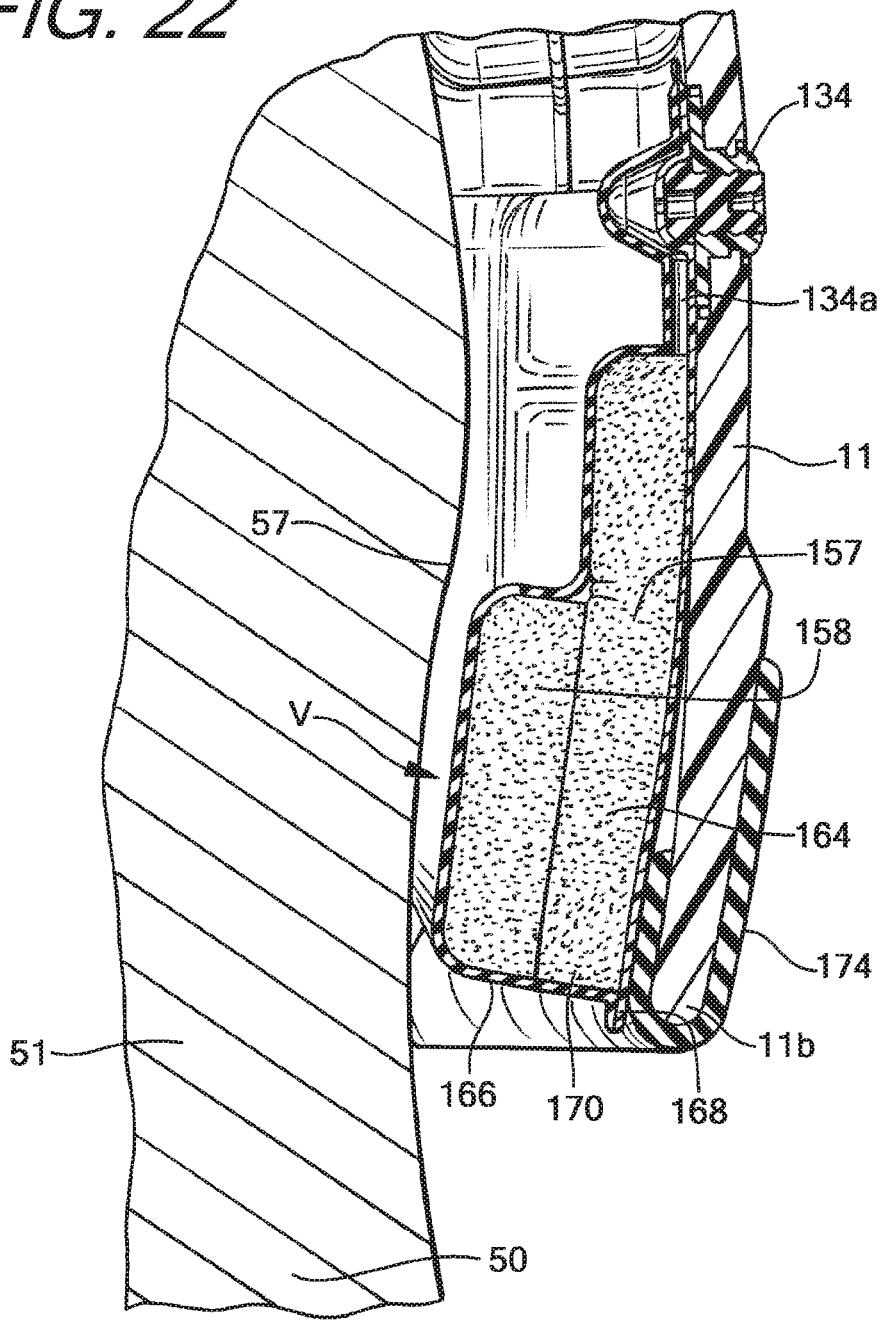
FIG. 22 is a sectional view of the occipital pad taken through line 22-22 of FIG. 21, showing the occipital pad in a deflated state; and, FIG. 23 is a sectional view of the occipital pad taken through line 22-22 of FIG. 21, showing the occipital pad in an inflated state.
Figure 23:
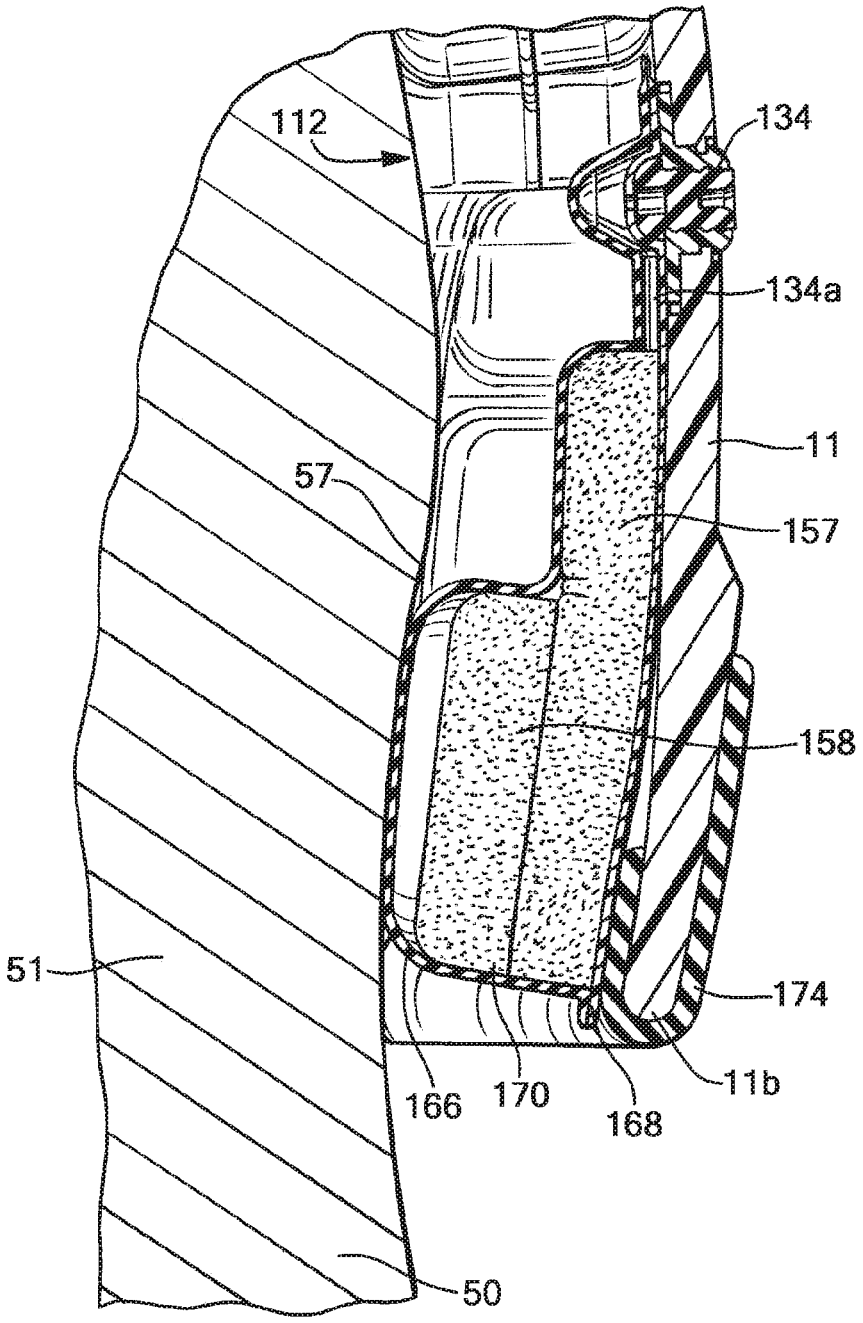

The occipital cradle pad assembly 114 includes a housing 164 for the pad elements 156-158 consisting of a first vinyl sheet 166 vacuum formed with a second vinyl sheet 168. Referring to FIGS. 22 and 23, a portion of the housing 164 that is in fluid communication with the valve 134 and air channel 134*a* is inflatable to allow for independent and customized engagement of the intermediate pad element 158*a* with the occipital protuberance 57. As shown, the central pad element 157 and the intermediate pad element 158 include at least one pad member 170, such as Dertex VN 600 PVC nitrile foam padding. In one embodiment, the central pad element 157 and the intermediate pad element 158 have a thickness ranging from 0.5 to 1.0 inch. Referring back to FIG. 21, the housing 164 includes peripheral sealed regions 172 adjacent the slot 156*c* and the intermediate pad element 158. The lower extent of the sealed regions 172*a, b*, the intermediate pads 158*a, b* and the peripheral pads 156*a, b* combine to define a lower edge of the occipital pad assembly 114 that is substantially adjacent the lower rear edge 11*b* of the helmet shell 11. As shown in FIGS. 22 and 23, the lower rear edge 11*b* is received by a rear nameplate or bumper 174, wherein the occipital pad assembly 114 engages the rear bumper 174.

While the specific embodiments have been illustrated and described, numerous modifications come to mind without significantly departing from the spirit of the invention, and the scope of protection is only limited by the scope of the accompanying Claims.

We claim:

1. A protective sports helmet comprising:

a helmet shell; and an internal padding assembly positioned within the helmet shell, the internal padding assembly including:

a brow pad adapted to be positioned adjacent a brow of a wearer of the helmet, the brow pad having opposed peripheral connection portions, wherein the brow pad extends continuously along an inner surface of the helmet shell and between the opposed peripheral connection portions, and wherein the brow pad has a thickness that exceeds a thickness of the helmet shell; and a jaw pad having a connection portion that mates with one of the opposed peripheral connection portions of the brow pad, wherein the connection portion of the jaw pad has a first connection segment that extends rearward and upward, and a second connection segment that extends forward and upward from the first connection segment.

2. The protective sports helmet of claim 1, wherein the jaw pad mates with one of the opposed peripheral connection portions of the brow pad above a front edge of the helmet shell.

3. The protective sports helmet of claim 1, the internal padding assembly further including a crown pad assembly having a plurality of pad elements, wherein at least one of the pad elements is partitioned by an internal separation layer to form an un-inflatable first chamber and an inflatable second chamber.

4. The protective sports helmet of claim 1, wherein the mating between the brow pad and the jaw pad is configured to provide continuous padding engagement from a jaw region of the wearer to a forehead of the wearer.

5. The protective sports helmet of claim 1, wherein one of the opposed peripheral connection portions of the brow pad is located along a lower peripheral portion of the brow pad.

6. The protective sports helmet of claim 5, wherein one of the opposed peripheral connection portions of the brow pad has a first connection segment that extends rearward and upward from a lower edge of the brow pad, and a second connection segment that extends forward and upward from the first connection segment.

7. The protective sports helmet of claim 1, the internal padding assembly further including an occipital pad assembly positioned along a lower rear edge of the helmet shell, wherein the occipital pad assembly has a pair of intermediate pad elements adapted to engage a head of the wearer of the helmet below the head's occipital bone.

8. The protective sports helmet of claim 1, wherein the internal padding assembly includes a crown pad that has a projection; and the brow pad includes a rear edge that extends between the opposed peripheral connection portions, said brow pad includes a recess that is adapted to receive the projection of the crown pad.

9. The protective sports helmet of claim 1, wherein the internal padding assembly includes a separate occipital pad, said occipital pad has a lower edge that resides adjacent to a rear lower edge of the helmet shell.

10. A protective sports helmet comprising:

a helmet shell;

an internal padding assembly positioned within the helmet shell, the internal padding assembly including:

a crown pad;

a brow pad adapted to be positioned adjacent a brow of a wearer of the helmet, the brow pad including: (i) a first peripheral connection portion, (ii) a second peripheral connection portion, and (iii) a rear edge, and wherein the first and second peripheral connection portions are in an opposed positional relationship, and wherein the brow pad extends continuously along an inner surface of the helmet shell and between the first and second peripheral connection portions;

wherein the rear edge extends between the first peripheral connection portion and the second peripheral connection portion and includes at least two projections that define a rear recess that is configured to receive an extent of the crown pad; and wherein each of the first and second peripheral connection portions of the brow pad has: (i) a first brow pad connection segment that extends from a lower edge of the brow pad, (ii) a second brow pad connection segment that extends forward from the first brow pad connection segment, and (iii) a third brow pad connection segment that extends upward from the second brow pad connection segment, wherein the second and third brow pad connection segments define a recess.

11. The protective sports helmet of claim 10, wherein the internal padding assembly includes a jaw pad that has: (i) a substantially linear lower edge, (ii) a substantially linear front edge extending upward from the lower edge of the jaw pad, and (iii) an upper edge that is inclined from the front edge of the jaw pad.

12. The protective sports helmet of claim 10, wherein the internal padding assembly includes:

a jaw pad that has: (i) a first connection portion that extends rearward and upward, and (ii) a second connection portion that extends rearward and downward; and a side pad having a connection portion that receives at least one of the first and second connection portions of the jaw pad.

13. The protective sports helmet of claim 10, wherein the internal padding assembly includes:

a first jaw pad having an upper connection portion that interconnects with the first peripheral connection portion of the brow pad;

a second jaw pad having an upper connection portion that interconnects with the second peripheral connection portion of the brow pad;

wherein the upper connection portion of each of the first and second jaw pads has: (i) a first jaw pad connection segment that extends rearward and upward, and (ii) a second jaw pad connection segment that extends forward and upward from the first jaw pad connection segment, and wherein the first and second jaw pad connection segments define a projection that is received by the recess.

14. The protective sports helmet of claim 13, wherein the upper connection portion of the first jaw pad interconnects with one of the peripheral connection portions of the brow pad above a front edge of the helmet shell.

15. The protective sports helmet of claim 13, wherein the interconnection between the brow pad and the first jaw pad is configured to provide continuous padding engagement from a jaw region of the wearer to a forehead region of the wearer.

16. The protective sports helmet of claim 13, wherein the brow pad extends along a front edge of the helmet shell and wherein the peripheral connection portions of the brow pad are positioned beyond a lateral edge of the helmet shell that depends downward from the front edge of the helmet shell.

17. The protective sports helmet of claim 13, wherein the rear edge includes a plurality of teeth that define a plurality of rear recesses that are configured to receive an extent of the crown pad.

18. A protective sports helmet comprising:

a helmet shell;

an internal padding assembly positioned within the helmet shell, the internal padding assembly including:

a jaw pad that has: (i) a substantially linear lower edge, (ii) a substantially linear front edge extending upward from said lower edge of the jaw pad, and (iii) an upper edge that is inclined from said front edge of the jaw pad;

a brow pad having a first peripheral connection portion and a second peripheral connection portion that are in an opposed positional relationship with one another, wherein the brow pad extends continuously along an inner surface of the helmet shell and between the first and second peripheral connection portions; and wherein each of the first and second peripheral connection portions of the brow pad has: (i) a first brow pad connection segment that extends from a lower edge of the brow pad, (ii) a second brow pad connection segment that extends forward from the first brow pad connection segment, and (iii) a third brow pad connection segment that extends upward from the second brow pad connection segment, wherein the second and third brow pad connection segments define a recess.

19. The protective sports helmet of claim 18, wherein the internal padding assembly includes a crown pad; and wherein the brow pad includes a rear edge that extends between the first peripheral connection portion of the brow pad and the second peripheral connection portion of the brow pad and includes at least two projections that define a rear recess that is configured to receive an extent of the crown pad.

20. The protective sports helmet of claim 18, wherein the jaw pad includes: (i) a first connection portion that extends rearward and upward, and (ii) a second connection portion that extends rearward and downward; and wherein the internal padding assembly includes a side pad having a connection portion that receives at least one of the first and second connection portions of the jaw pad.

* * * * *